US012722850B2

(12) United States Patent
Shute

(10) Patent No.: US 12,722,850 B2
(45) Date of Patent: Sep. 1, 2026

(54) STACKABLE BIN AND METHOD OF STACKING THE SAME

(71) Applicant: CREATIVE PLASTIC CONCEPTS, LLC, Sycamore, OH (US)

(72) Inventor: Matt Shute, Sycamore, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 19/201,643

(22) Filed: May 7, 2025

(65) Prior Publication Data

US 2025/0263199 A1 Aug. 21, 2025

Related U.S. Application Data

(63) Continuation-in-part of application No. 18/934,850, filed on Nov. 1, 2024.

(60) Provisional application No. 63/595,817, filed on Nov. 3, 2023.

(51) Int. Cl.
*B65D 21/02* (2006.01)
*B65D 25/28* (2006.01)

(52) U.S. Cl.
CPC ..... *B65D 21/0212* (2013.01); *B65D 25/2867* (2013.01); *B65D 2525/288* (2013.01)

(58) Field of Classification Search
CPC ..... A47B 57/04; A47B 81/00; A47B 87/02; B65F 2220/12; B65F 2220/124; B65F 1/16; B65D 21/0233; B65D 21/048; B65D 21/064; B65D 1/22; B65D 21/0219; B65D 21/0223; B65D 21/0212; B65D 43/0164; B65D 2543/00537; B65D 43/163
USPC ..... 220/23.83, 4.27, 23.6; 206/508, 505, 206/509, 511, 507
See application file for complete search history.

(56) References Cited

U.S. PATENT DOCUMENTS

| | | | | |
|---|---|---|---|---|
| 2,609,120 A * | 9/1952 | Williams | B65D 21/062 220/756 |
| 6,041,931 A * | 3/2000 | Jacques | F25D 3/08 206/508 |
| 7,530,465 B2 * | 5/2009 | Holland | B65F 1/0053 220/505 |
| 11,878,839 B2 * | 1/2024 | Whitta | B65D 25/282 |
| 2023/0100589 A1 * | 3/2023 | Whitta | B65D 25/282 206/505 |

* cited by examiner

*Primary Examiner* — King M Chu
(74) *Attorney, Agent, or Firm* — Thompson Coburn LLP

(57) ABSTRACT

The present disclosure relates to a first storage bin having a main body with a base wall, side walls, a rear wall, and a front wall defining an open top, a partly open front, and a rim with built-in handles. Each side wall has an inner surface with a platform and an outer surface with a channel. The platform has a stacking surface adjacent to the rim. The bin also includes a movable handle attached to the rim, which is movably connected to the main body. The flip handle can be in an opened position, allowing stacking of the first storage bin with a second storage bin, or in a closed position, allowing nesting of the first storage bin with the second storage bin, without any lateral offset between the first and second storage bins so that there is no lean in either the stacked or nested arrangements.

20 Claims, 27 Drawing Sheets

STACKABLE BIN AND METHOD OF STACKING THE SAME

CROSS-REFERENCE AND PRIORITY CLAIM TO RELATED PATENT APPLICATION

This patent application claims priority to U.S. patent application Ser. No. 18/934,850, filed Nov. 1, 2024, and entitled "Stackable Bin and Method of Stacking the Same", and U.S. provisional patent application 63/595,817, filed Nov. 3, 2023, and entitled "Stackable Bin and Method of Stacking the Same", the entire disclosures of which are incorporated herein by reference.

FIELD

The present technology relates to storage containers, and more specifically, to stackable open top bins for storing and transporting goods.

INTRODUCTION

This section provides background information related to the present disclosure which is not necessarily prior art.

Storage bins are commonly used in residential, and commercial settings to store goods like files, supplies, office materials, recreational equipment, or food. Often, multiple storage bins are used in a single setting together, so storage bins that can be stored in an organized and stable configuration are ideal. Storage bins are also commonly used in settings where the capability to transport many stored objects at once is necessary and efficient. Such storage bins may be stored and transported in various arrangements, for example, by stacking storage bins on top of one another.

Furthermore, storage bins that are both stackable and nestable are well known. Such storage bins are especially useful for neatly storing items such as products, parts, and tools in a garage, basement, utility room, or car trunks. In operation, where there is a plurality of the storage bins for storage or transport, the storage bins can be arranged in a stacked position or in a nested position. The stacked position is especially useful for the storage of the items in the storage bins. The nested position is especially useful for shipping of the storage bins. Typically, the storage bins are shipped in a stacked arrangement, and then the stacked arrangements are shipped in bulk on a pallet.

One known problem with conventional storage bins is that they must have a lateral offset from one another in order to be placed in the nested position. This means that the storage bins are usually nested at an angled orientation such that the nested arrangements lean in a forward direction. This makes it inconvenient to ship the nested arrangements of the storage bins in the nested position.

Accordingly, there is a continuing need for a stackable storage bin that can be nested with other stackable storage bins in a manner so that the nested arrangement has a straight orientation and does not lean in the forward direction. Desirably, the stackable storage bin offers both convenience in stackability and nesting capability without the need for additional adjustments or compromises in stability of the nested arrangement.

SUMMARY

In concordance with the instant disclosure, a stackable storage bin that can be nested with other stackable storage bins in a manner so that the nested arrangement has a straight orientation and does not lean in the forward direction, and which offers both convenience in stackability and nesting capability without the need for additional adjustments or compromises in stability of the nested arrangement, has surprisingly been discovered.

The present technology includes articles of manufacture, systems, and processes that relate to open top storage bins.

In one embodiment, a first storage bin comprises a main body and first and second movable handles. The main body comprises a base wall, a first side wall, a second side wall opposite the first side wall, a rear wall, a front wall and a rim. The main body has an open top and a partly open front. The rim is on the side walls and the rear wall. Each of the first and second side walls has an inner surface and an outer surface. A platform is formed on the inner surface of each of the first and second side walls, and a channel is formed on the outer surface of each of the first and second side walls opposite the platform. The first movable handle is attached to the main body of the first storage bin adjacent the first wall. The first movable handle has a first handle locking element. The second movable handle is attached to the main body of the first storage bin adjacent the second wall. The second movable handle has a second handle locking element. Each of the first and second movable handles is connected to the main body and is movable between an opened position and a closed position. The movable handles in the opened position permit a stacked arrangement of the first storage bin with a second storage bin identical to the first storage bin. The movable handles in the closed position permit a nested arrangement of the first storage bin with the second storage bin. Both the stacked arrangement and the nested arrangement are permitted without a lateral offset between the first storage bin and the second storage bin. The base wall of the main body has a first base locking element and a second base locking element. The first and second base locking elements and the first and second handle locking elements are arranged and configured such that when the first storage bin is stacked atop the second storage bin, the first storage bin is movable relative to the second storage bin between a locked position and an unlocked position. The unlocked position is a position in which the first storage bin can be lifted off the second storage bin. The locked position is a position in which the first base locking element of the first storage bin inter-engages the first handle locking element of the second storage bin and the second base locking element of the first storage bin inter-engages the second handle locking element of the second storage bin to prevent the first storage bin from being lifted from the second storage bin.

In another embodiment, a pair of storage bins comprises a first storage bin and a second storage bin. The first storage bin has a main body with a base wall having a first base locking element and a second base locking element. The second storage bin comprises a main body, a first movable handle and a second movable handle. The main body has a first side wall and a second side wall. The first movable handle is attached to the main body adjacent the first side wall. The first movable handle has a first handle locking element. The second movable handle is attached to the main body adjacent the second side wall. The second movable handle has a second handle locking element. Each of the first and second movable handles are connected to the main body of the second storage bin and movable between an opened position and a closed position. The movable handles in the opened position permitting a stacked arrangement of the first storage bin atop the second storage bin. The movable handles in the closed position permitting a nested arrangement of the first storage bin within the second storage bin, with both the stacked arrangement and the nested arrangement permitted without a lateral offset between the first storage bin and the second storage bin. The first storage bin is configured to be placed in a stacked arrangement on the second storage bin. In the stacked arrangement, the first and second base locking elements and the first and second handle locking elements are arranged and configured such that the first storage bin is movable relative to the second storage bin between a locked position and an unlocked position. The unlocked position is a position in which the first storage bin can be lifted off the second storage bin. The locked position is a position in which the first base locking element inter-engages the first handle locking element and the second base locking element inter-engages the second handle locking element to prevent the first storage bin from being lifted from the second storage bin.

The first base locking element may comprise a first locking projection. The second base locking element may comprise a second locking projection. The first handle locking element may comprise a first catch. The second handle locking element may comprises a second catch. When the first storage bin is in the locked position with the second storage bin, the first locking projection of the first storage bin may be configured to be received by the catch of the second storage bin, and the second locking projection of the first storage bin may be configured to be received by the second catch of the second storage bin.

In another embodiment, a pair of storage bins comprises a first storage bin and a second storage bin. Each of the first storage bin and the second storage bin includes a main body, a first movable handle and a second movable handle. The main body comprises a base wall, a first side wall, a second side wall opposite the first side wall, a rear wall, a front wall, and a rim being on the side walls and rear wall. The main body has an open top and a partly open front. The rim has built-in handles. Each of the first and second side walls has an inner surface and an outer surface. A platform is formed on the inner surface of each of the first and second side walls. A channel is formed on the outer surface of each of the first and second side walls opposite the platform. The platform has a stacking surface disposed adjacent to the rim. The first movable handle is attached to the rim adjacent the first side wall. A second movable handle is attached to the rim adjacent a second side wall. Each of the first and second movable handles are movably connected to the main body between an opened position and a closed position. Where each of the first and second movable handles of the first storage bin is in the opened position and the second storage bin is stacked on the first storage bind, there is no lateral offset between the first storage bin and the second storage bin. Where each of the first and second movable handles of the first storage bin is in the closed position and the second storage bin is nested in the first storage bin, there is no lateral offset between the first storage bin and the second storage bin.

In another embodiment, a method for stacking and nesting a first storage bin with a second storage bin, the method comprising each of first storage bin and the second storage bin including a main body and first and second movable handles. The main body comprises a base wall, a first side wall, a second side wall opposite the first side wall, a rear wall, a front wall and a rim being on the side walls and rear wall. The main body has an open top, a partly open front, the rim having built-in handles. Each of the side walls has an inner surface and an outer surface. A platform is formed on the inner surface of each of side walls, and a channel is formed on the outer surface of each of the side walls opposite the platform. The platform has a stacking surface disposed adjacent to the rim. The first movable handle is attached to the rim adjacent the first side wall. The second movable handle is attached to the rim adjacent the second side wall. Each of the first and second movable handles are movably connected to the main body between an opened position and a closed position. Each of the first and second movable handles in the opened position permits a stacked arrangement of the first storage bin with the second storage bin, and each of the first and second movable handles in the closed position permits a nested arrangement of the first storage bin with the second storage bin. Both the stacked arrangement and the nested arrangement are permitted without a lateral offset between the first storage bin and the second storage bin. The method comprises, with the first and second movable handles of the first storage bin being in the opened positions, placing the base wall of the second storage bin on the first and second movable handles of the first storage bin, whereby the base wall of the second storage bin is supported by the first and second movable handles of the first storage bin in a stacked arrangement without the second storage bin being laterally offset from the first storage bin. The method further comprises, with the first and second movable handles of the first storage bin being in the closed positions, sliding the platform of the first storage bin into the channel of the second storage bin in a nested arrangement, whereby the base wall of the second storage bin is disposed adjacent the base wall of the first storage bin without the second storage bin being laterally offset from the first storage bin.

In one embodiment, a storage bin includes a main body with a base wall, a pair of spaced opposed side walls, a rear wall, and a front wall that together define an open top of the main body. The main body also has a partly open front, and a rim formed by the side walls and rear wall. The rim has built-in handles. Each of the side walls has an inner surface and an outer surface.

A platform is formed on the inner surface of each of the side walls. A channel is formed on the outer surface of each of the side walls opposite the platform. The platform has a stacking surface disposed adjacent to the rim. A flip handle is attached to the rim. The flip handle has a first end, a second end, a first side, a second side, an outer surface, and an inner surface.

The flip handle is rotatably connected to the main body about an axis of rotation between an opened position and a closed position. The flip handle in the opened position permits a stacked arrangement of the storage bin with a second storage bin, and the flip handle in the closed position permits a nested arrangement of the storage bin with the second storage bin, with both the stacked arrangement and the nested arrangement permitted without a lateral offset between the storage bin and the second storage bin.

The main body of the first storage bin or the second storage bin may further comprise a first set of oblong holes and a second set of oblong holes. The first movable handle comprises first and second ends projecting into the oblong holes of the first set to enable the first movable handle to be rotatably connected to the main body. The second movable handle comprises first and second ends projecting into the oblong holes of the second set to enable the second movable handle to be rotatably connected to the main body.

In another embodiment, a stacked arrangement of the storage bins includes a first storage bin and a second storage bin. In this arrangement, the flip handle of the first storage bin is in the opened position, and the second storage bin is stacked on the first storage bin without a lateral offset between the two storage bins.

In a further embodiment, a nested arrangement of the storage bins includes a first storage bin and a second storage bin. In this arrangement, the flip handle of the first storage bin is in the closed position, and the second storage bin is nested in the first storage bin without a lateral offset between the two storage bins.

In yet another embodiment, a method for stacking storage bins includes a step of providing a first storage bin and a second storage bin. The method further includes a step of rotating the flip handle of the first storage bin to an opened position. The method also includes a step of placing the base wall of the second storage bin on the flip handle and the stacking surface of the platform of the first storage bin, with the flip handle being disposed between the stacking surface and the base wall of the second storage bin. The base wall of the second storage bin is thereby supported by the flip handle of the first storage bin without a lateral offset between the two storage bins.

In yet a further embodiment, a method for nesting storage bins includes a step of providing a first storage bin and a second storage bin. The method further includes a step of rotating the flip handle of the first storage bin to the closed position. The method also includes a step of sliding the platform of the first storage bin into the channel of the second storage bin. The base wall of the second storage bin is thereby disposed adjacent to the base wall of the first storage bin without a lateral offset between the two storage bins.

In an exemplary embodiment, a storage bin has a flip handle on the rim. The flip handle has an opened position and a closed position. The flip handle of the first storage bin in the opened position is supported by the stacking surface of the platform of the first storage bin so that the storage bins are stacked. Where the flip handle is in the closed position, the base wall of the second storage bin rests on the flip handle of the first storage bin so that the storage bins are stacked in the stacked arrangement. Where the flip handle is in the closed position, the platform of the first storage bin is slidably received by the channel of the second storage bin so that the storage bins are nested in the nested arrangement. There is no lateral offset between the storage bins in the nested position relative to the stacked position due to the use of the flip handle in the opened position for supporting the storage bins in the stacked arrangement. This allows for the stacked arrangements to be stacked in the straight orientation such that the stacked arrangements do not no lean in the forward direction, which solves the stacking problem associated with the storage bins of the prior art.

The flip handle of the storage bin of the present disclosure has a first side, a second side, a first end, a second end, an outer surface, and an inner surface. The first side of the flip handle at the first end is rotatably connected to the main body with a first pin, and the first side of the flip handle at the second end is rotatably connected to the main body with a second pin. The flip handle also has an outer surface and an inner surface. The inner surface of the flip handle has a plurality of ribs. The ribs are spaced apart along a length of the flip handle and extend between the first side and the second side of the flip handle. The ribs are important because when pressure is applied to them upon the storage bins being placed in the stacked arrangement, it militates against a middle of the flip handle lifting up and therefore contributes to a retaining of the first pin and the second pin in the main body. A central protrusion may also be provided on the rim adjacent to the first side of the flip handle where in the opened position. The central protrusion cooperates with a central recess on the inner surface of the flip handle where the flip handle is in the closed position, thereby making the flip handle stronger or more robust in the closed position.

The flip handle also has a flange at the second side of the flip handle. The base wall of the second storage bin is supported by the flange of the first storage bin where the storage bins are in the stacked position. The base wall of the second storage bin may also be provided with a channel that receives the flange of the flip handle of the first storage bin where in the stacked position. The channel allows for the storage bins to be locked into place and for the bins to make contact at two of the channels and at four areas around the storage bins when in the flip handle is in the opened position and the storage bins are in the stacked position.

The flip handle in the closed position rests on a handle base, which extends outwardly from the rim of each of the side walls of the main body. The handle base also has a plurality of weight-bearing ribs that provide additional support of the storage bins. The handle base may also have a plurality of drainable holes formed through the handle base that militate against water collecting inside of the handle base.

The main of the first storage bin may further comprise first and second slots. Each of the first and second slots may comprise a plurality of interlocking teeth configured to limit movement of the first storage bin relative to the second storage bin in the locked position.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
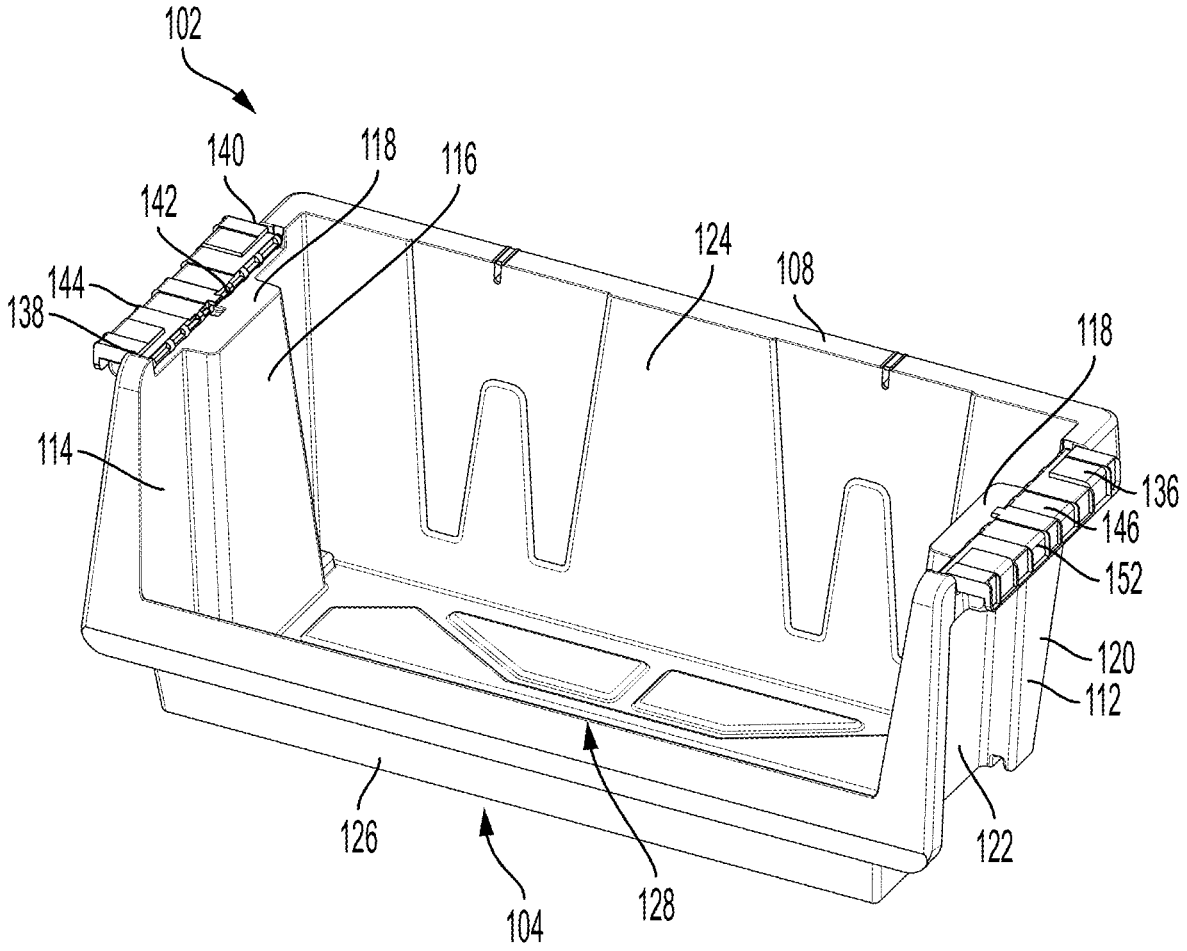
FIG. 1 is a front perspective view of one embodiment of a storage bin having a main body and movable handles, the movable handles being in the closed position.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps may be different in various embodiments, including where certain steps may be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms.

These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

The present technology improves storage containers, and more specifically, open top bins for transport and storage of goods.

With reference to FIG. 1, a first storage bin 102 comprises a main body 104 and first and second movable handles 136. In FIG. 1, the movable handles are shown in a closed position. The movable handles 136 are movable between the closed position (see FIG. 1) and an open position (see FIG. 2). The main body 104 has a base wall, a rim 108, two oppositely opposed side walls 112, a rear wall 124, and a front wall 126. The main body 104 has a partly open front 128 of the first storage bin 102. Each of the side walls 112 has an inner surface 114 and an outer surface 120. The main body 104 has a platform 116 with a stacking surface 118 adjacent the rim 108. The platform is adjacent the inner surface 114 of the side wall 112. The outer surface 120 of the side wall 112 has a channel 122 opposite the platform 116. Each of the outer surfaces 120 includes a channel 122. Each of the inner surfaces 114 includes a platform 116. The main body 104 may be of a single molded construction and may be of a polymer material. The movable handle 136 may also be of a single molded construction and of a polymer material. In combination, the first storage bin may be comprised of three parts formed together: a main body 104, a first movable handle, and a second movable handle.

The movable handle 136 has a first side 142 attached to the rim 108 and a second side 144. The movable handle 136 further has a first end 138 and a second end 140. As shown in FIG. 1, the movable handle 136 has an outer surface 146. The movable handle in FIG. 1 is shown in the closed position. In the closed position, the outer surface 146 may be seen via a front perspective view. The movable handle 136 also has a flange 152 located at the second side 144 of the movable handle. The movable handle 136 may be a flip handle or any other type of movable handle capable of moving relative to the rim 108, for example, a sliding handle or a snapping handle.

Figure 2:
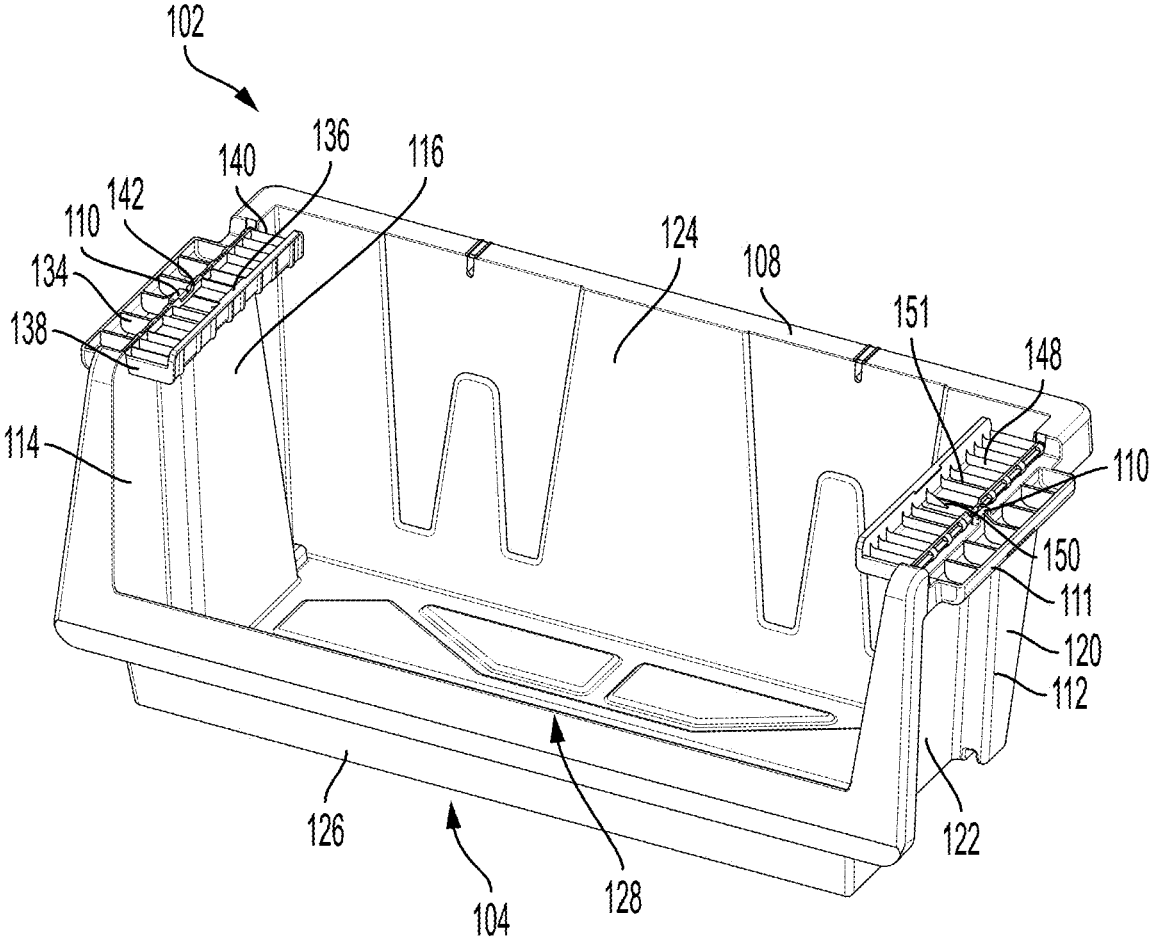
FIG. 2 is a front perspective view of the storage bin of FIG. 1 with the movable handles being in the opened position.

Referring to FIG. 2, the movable handle 136 includes an inner surface 148. The inner surface 148 has a plurality of ribs 151 extending from the first side 142 to the second side 144.

As further shown in FIG. 2, the main body 104 of the first storage bin 102 has a built-in handle base 111 with a built-in handles that extend outwardly from the rim 108. The handle base 111 includes weight-bearing ribs 134 for extra structural support. FIG. 2 further shows the central protrusion 110 located on the rim which is aligned with the central recess 150 in the movable handle 136. The central protrusion 110 cooperates with a central recess 150 on the inner surface 148 of the movable handle 136 where the movable handle 136 is in the closed position to at least partially support the movable handle 136 in the closed position.

Figure 3:
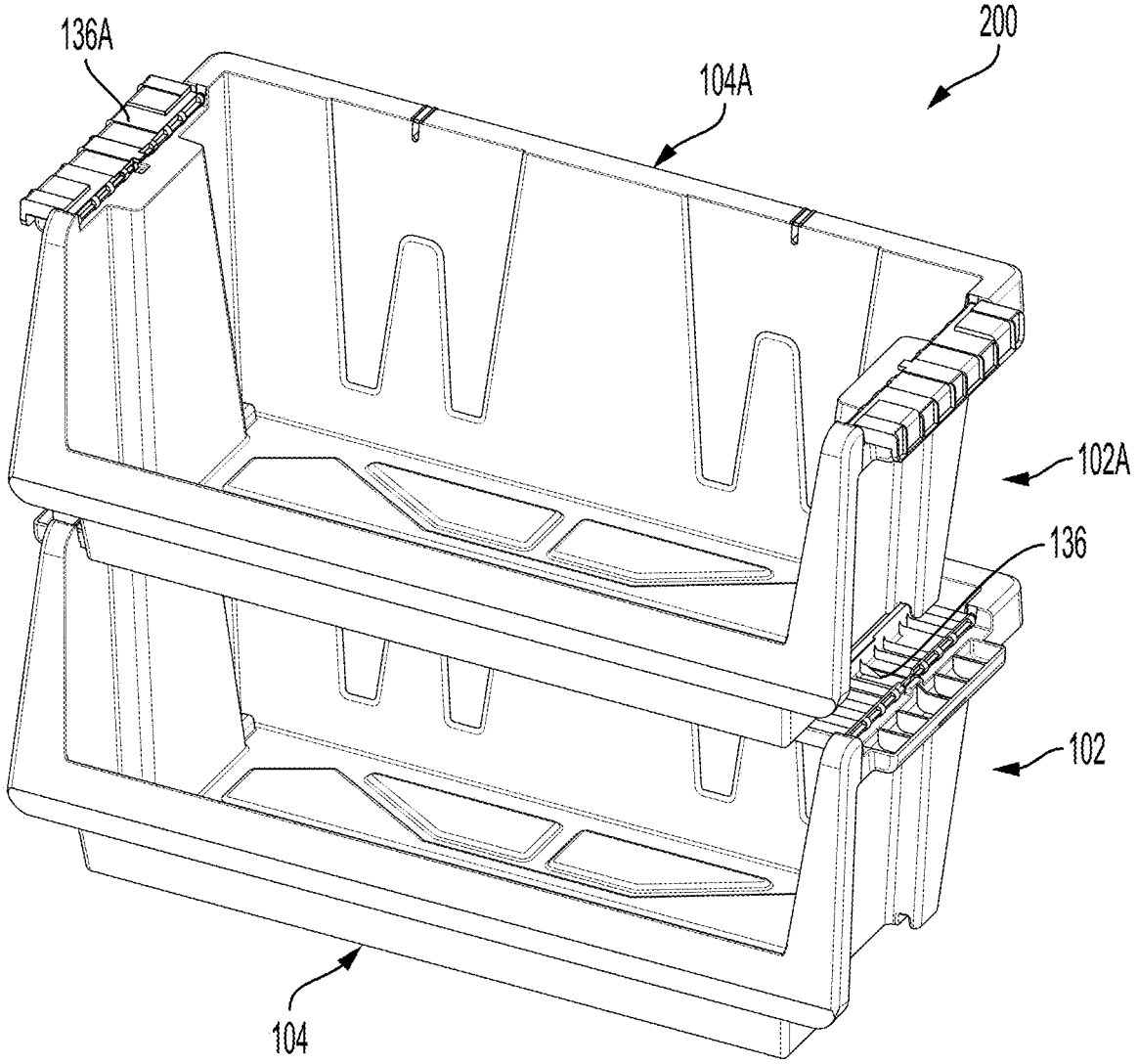
FIG. 3 is a front perspective view of two storage bins in a stacked arrangement, each of the two storage bins being of the embodiment of FIGS. 1 and 2.

As shown in FIG. 3, which shows a stacked arrangement 200, a second storage bin 102A is stacked onto a first storage bin 102. The second storage bin 102A is identical to the first storage bin 102. As such, the second storage bin 102A has the same features as the first storage bin 102, including a main body 104A and a movable handle 136A. The movable handle 136 on the first storage bin 102 is in the opened position while the first storage bin 102 and the second storage bin 102A are in the stacked arrangement. The movable handle 136 supports the second storage bin 102A and is supported by the stacking surface 118.

Figure 4:
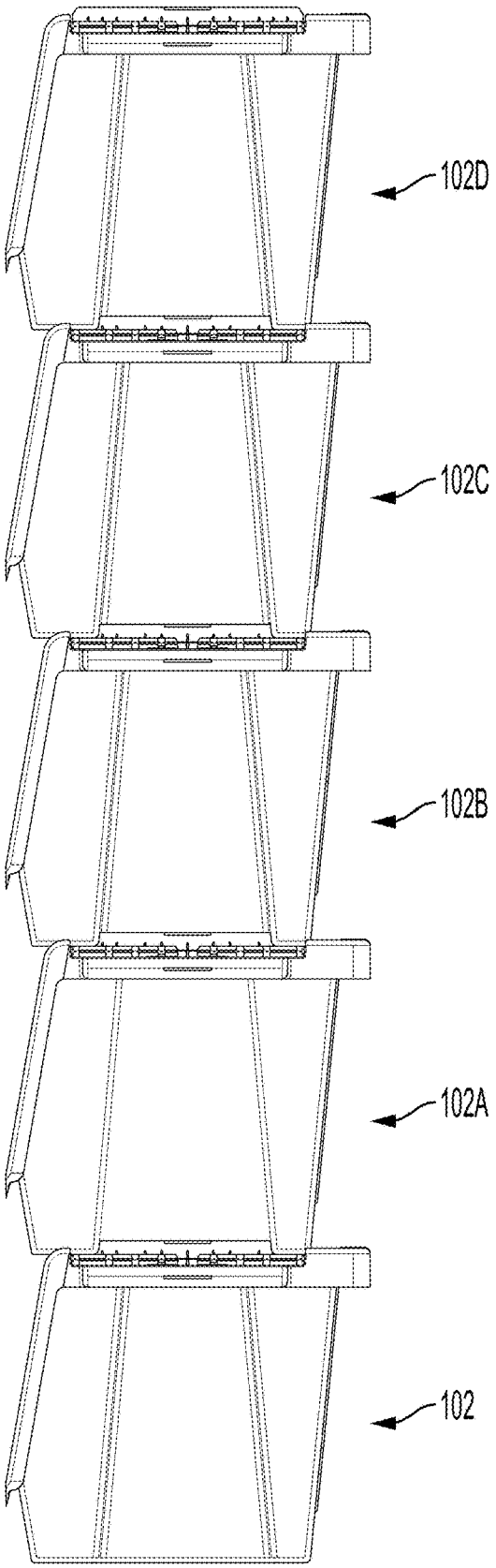
FIG. 4 is a side view of five storage bins in a stacked arrangement, each of the five storage bins being of the embodiment of FIGS. 1 and 2.

As shown in FIG. 4, multiple storage bins may be placed in a stacked arrangement. For example, a fifth storage bin 102D may be stacked on a fourth storage bin 102C, which may be stacked on a third storage bin 102B, which may be stacked on the second storage bin 102A, which may be stacked on the first storage bin 102. This may continue for additional stacking of storage bins. As shown in FIG. 4, the storage bins are stacked without any lateral offset between any of the storage bins, causing the storage bins to stack vertically.

Figure 5:
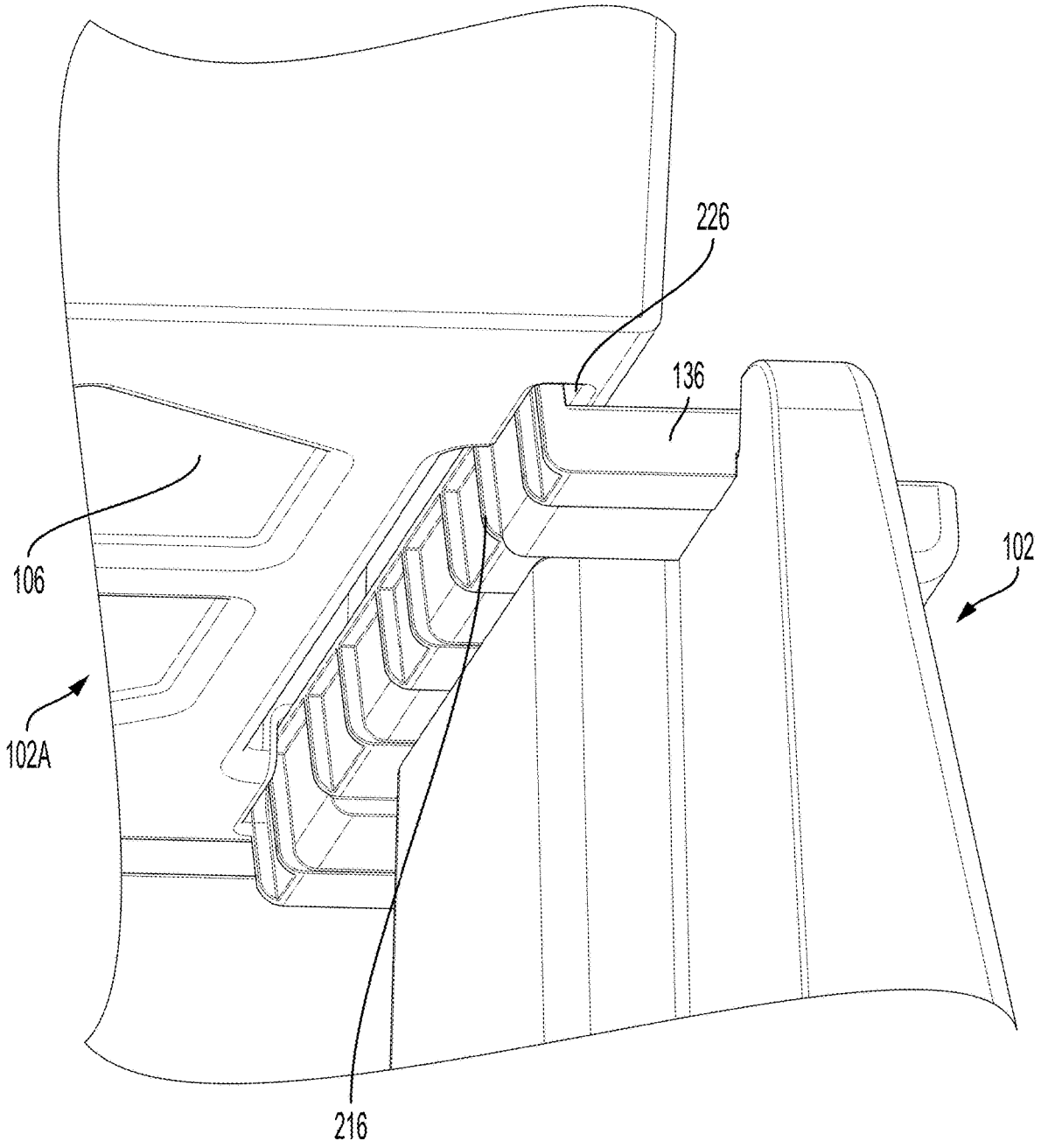
FIG. 5 is a sectional view of the storage bins of FIG. 3 in a stacked arrangement.

As shown in FIG. 5, which is a sectional view of a stacked arrangement, a second storage bin 102A is stacked on a first storage bin 102. A base wall 106 of the main body 104 is shown on the second storage bin 102A. A slot 226 is located in the bottom surface of the base wall 106. The slot 226 is configured to receive the flange 216 of the movable handle 136. The base wall 106 may have two slots, where each slot is configured to receive a flange of a movable handle. One movable handle 136 may be located on a first side wall while the other movable handle 136 may be located on a second side wall. Each movable handle may have a flange 216. One slot may be configured to receive the flange on the first movable handle 136 and the other slot may be configured to receive the flange on the second movable handle 136. The flanges 216 may be inserted into the slots 226 to limit lateral movement of the second storage bin 102A when the first storage bin 102 and the second storage bin 102A are in the stacked arrangement. The slots 226, in combination with the flanges 216 provide extra stability for the storage bins in the stacked arrangement.

Figure 6:
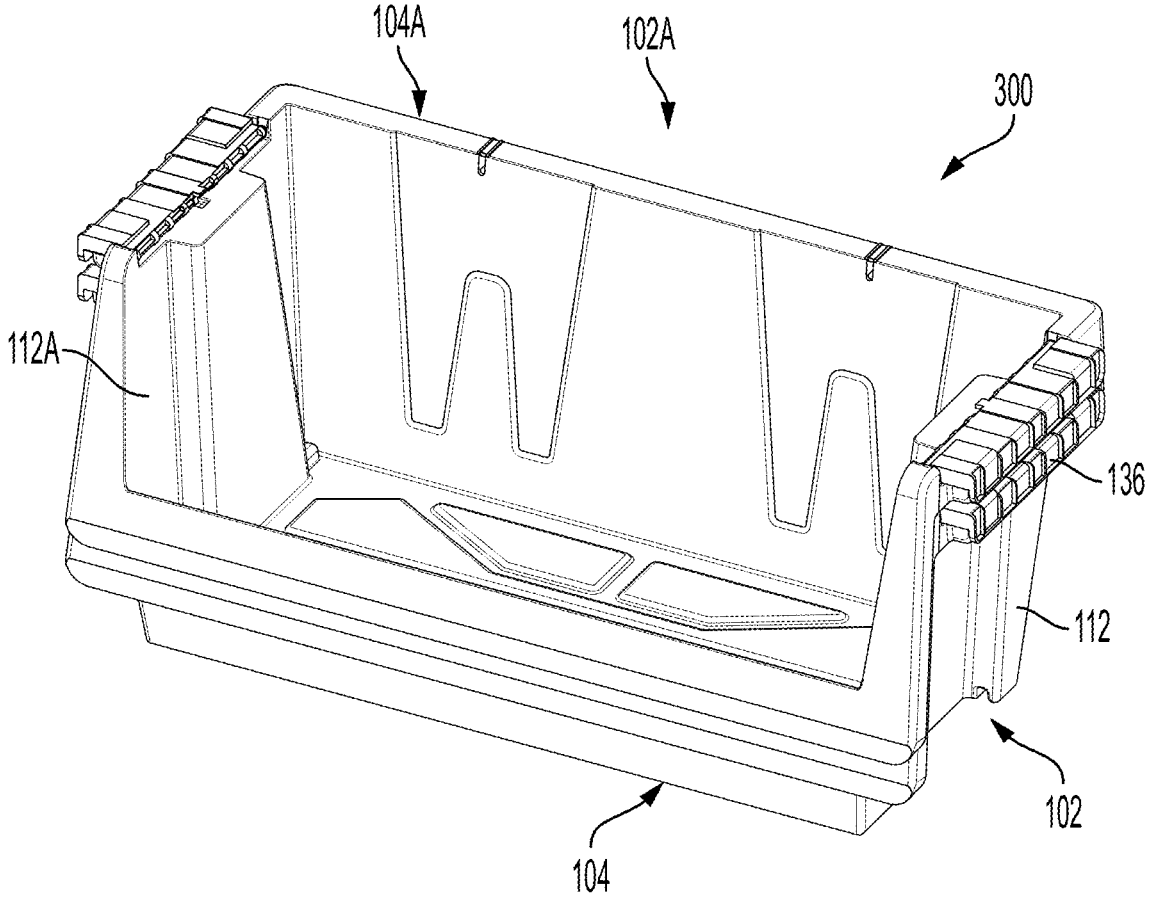
FIG. 6 is a front perspective view of the storage bins of FIG. 3 in a nested arrangement.

As shown in FIG. 6, which is a front perspective view of a nested arrangement 300, the second storage bin 102A is nested in the first storage bin 102. As such, the second storage bin 102A has the same features as the first storage bin 102, including the main body 104A and the side walls 112A. In the nested arrangement 300, the movable handle 136 is in the closed position. In the closed position, the movable handle 136 is not supported by the stacking surface 118.

Figure 7:
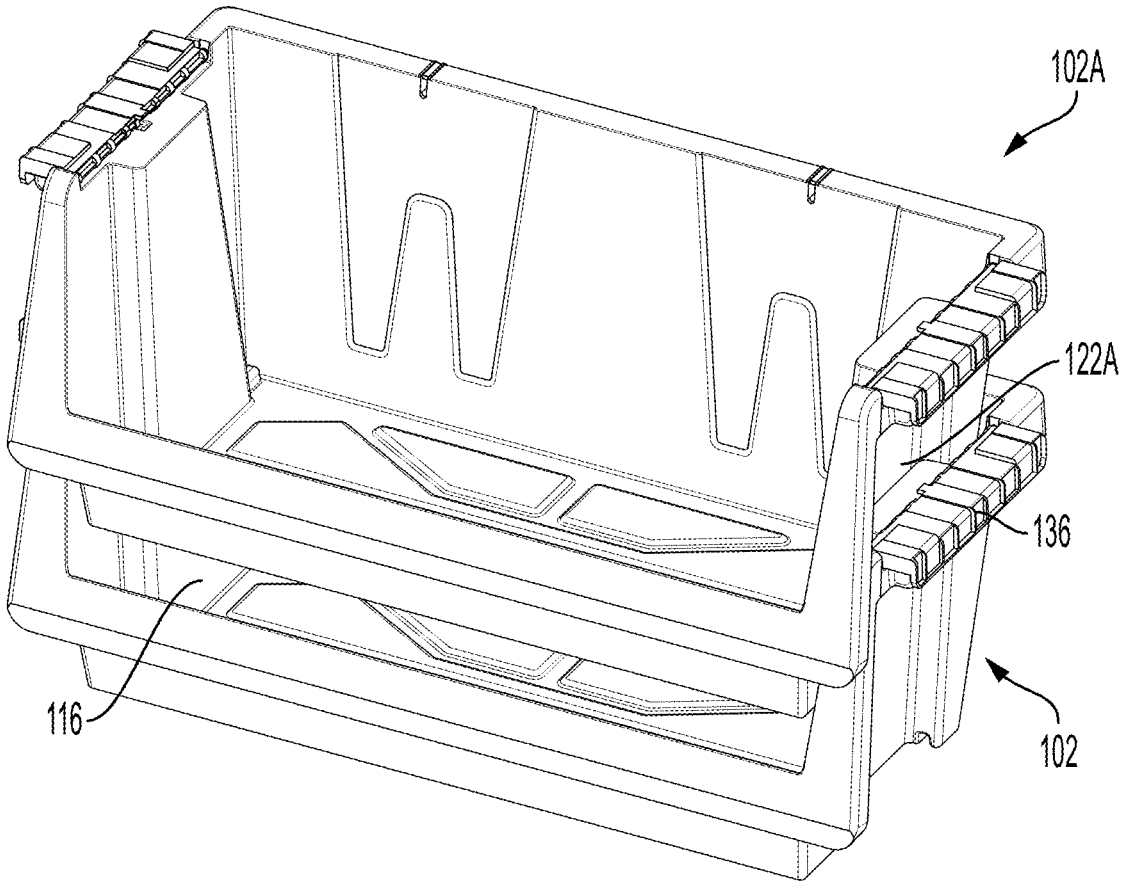
FIG. 7 is a front perspective similar to FIG. 6, but showing the storage bins in a partially nested arrangement.

As shown in FIG. 7, the channel 122A of the second storage bin 102 may slide over the platform 116 of the first storage bin 102 as the second storage bin is nested with the first storage bin. Both the platform 116 and the channel 122A are pitched from the rim 108 to the base wall 106, with both the platform 116 and the channel 122A being narrower near the rim 108 than near the base wall 108. This allows the platform 116 of the first storage bin 102 to slide in the channel 122A of the second storage bin 102A. This configuration prevents lateral movement of the two storage bins and promotes stability while the storage bins are in a nested arrangement.

Figure 8:
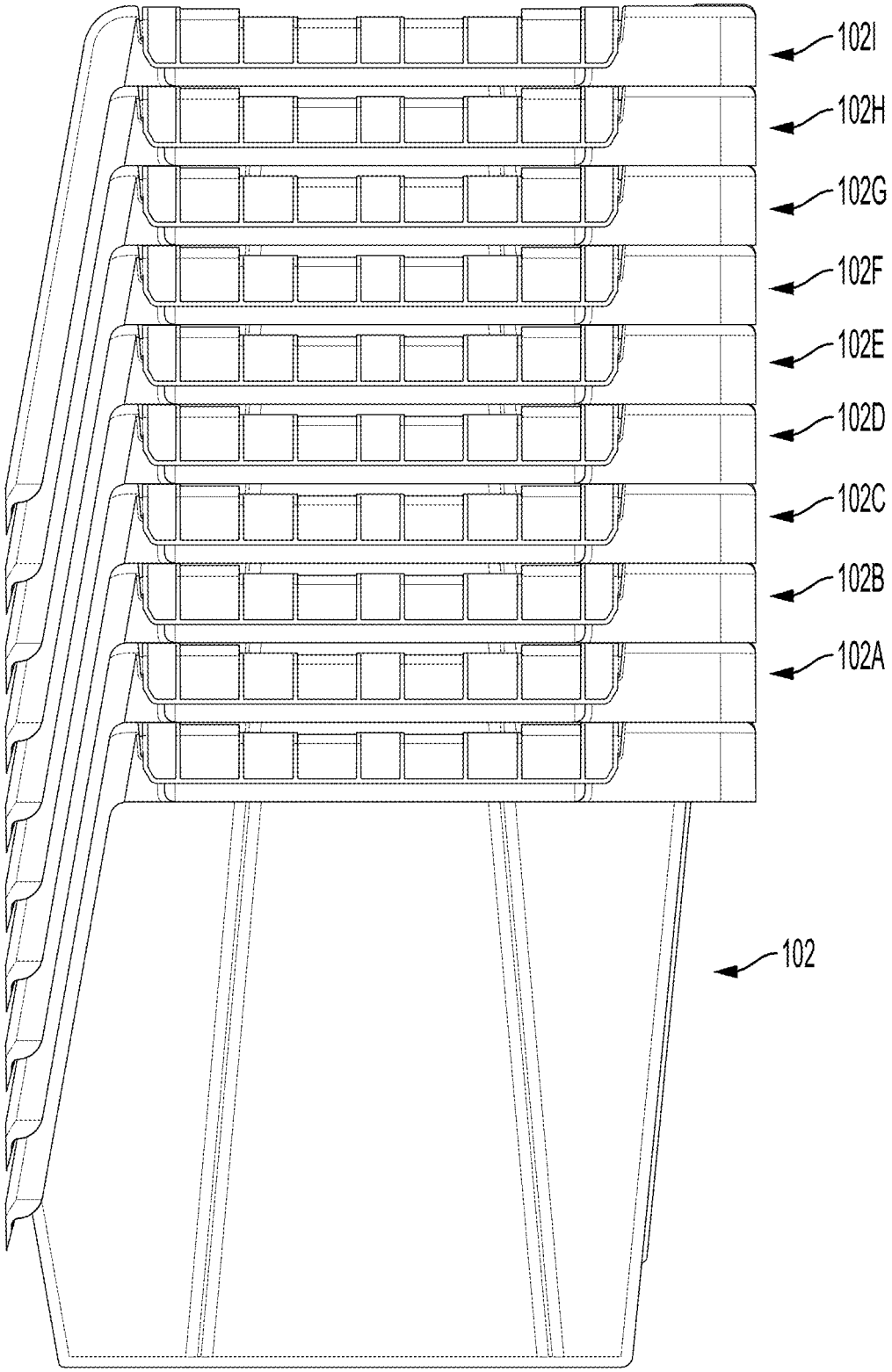
FIG. 8 is a side view of ten storage bins in a nested arrangement, each of the ten storage bins being of the embodiment of FIGS. 1 and 2.

As shown in FIG. 8, a tenth storage bin 102I is nested in a ninth storage bin 102H, which is nested in an eighth storage bin 102G, which is nested in a seventh storage bin 102F, which is nested in a sixth storage bin 102E, which is nested in a fifth storage bin 102D, which is nested in a fourth storage bin 102C, which is nested in a third storage bin 102B, which is nested in the second storage bin 102A, which is nested in the first storage bin 102. This may continue for additional nesting of storage bins. As shown in FIG. 8, the storage bins are nested without any lateral offset between any of the storage bins, causing the storage bins to nest vertically.

Figure 9:
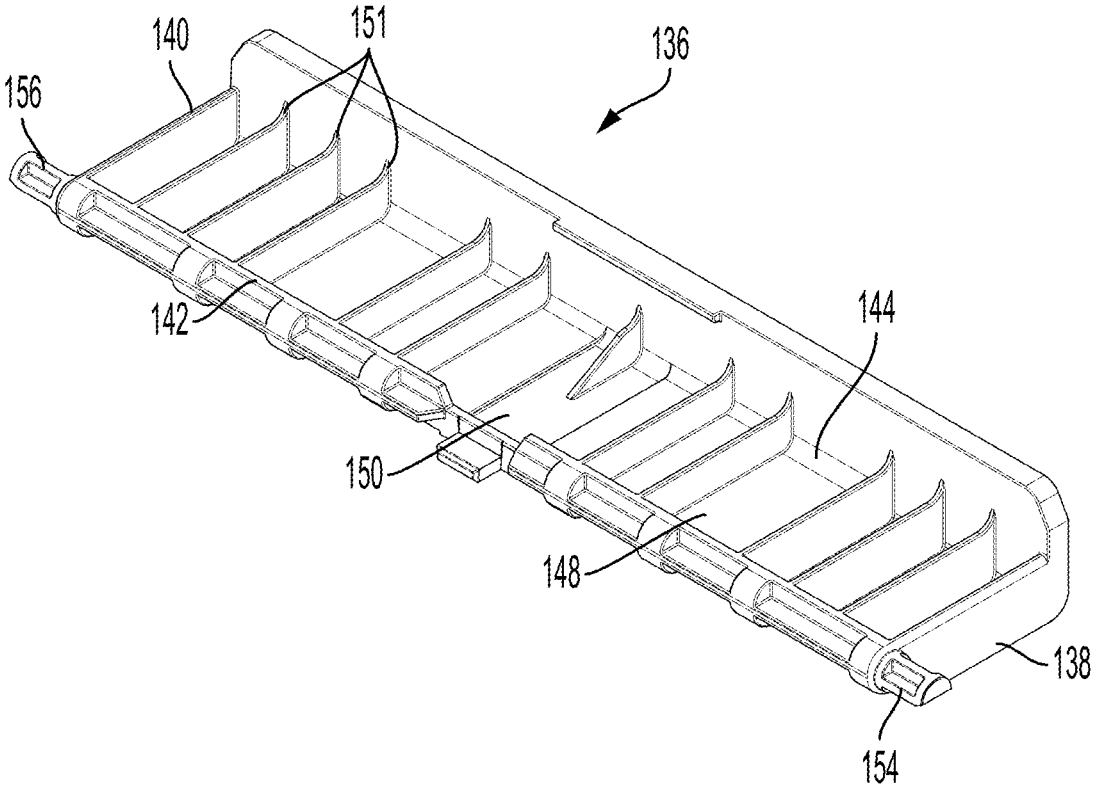
FIG. 9 is a perspective view of the inner surface of one of the movable handle of the embodiment of FIGS. 1 and 2.
Figure 10:
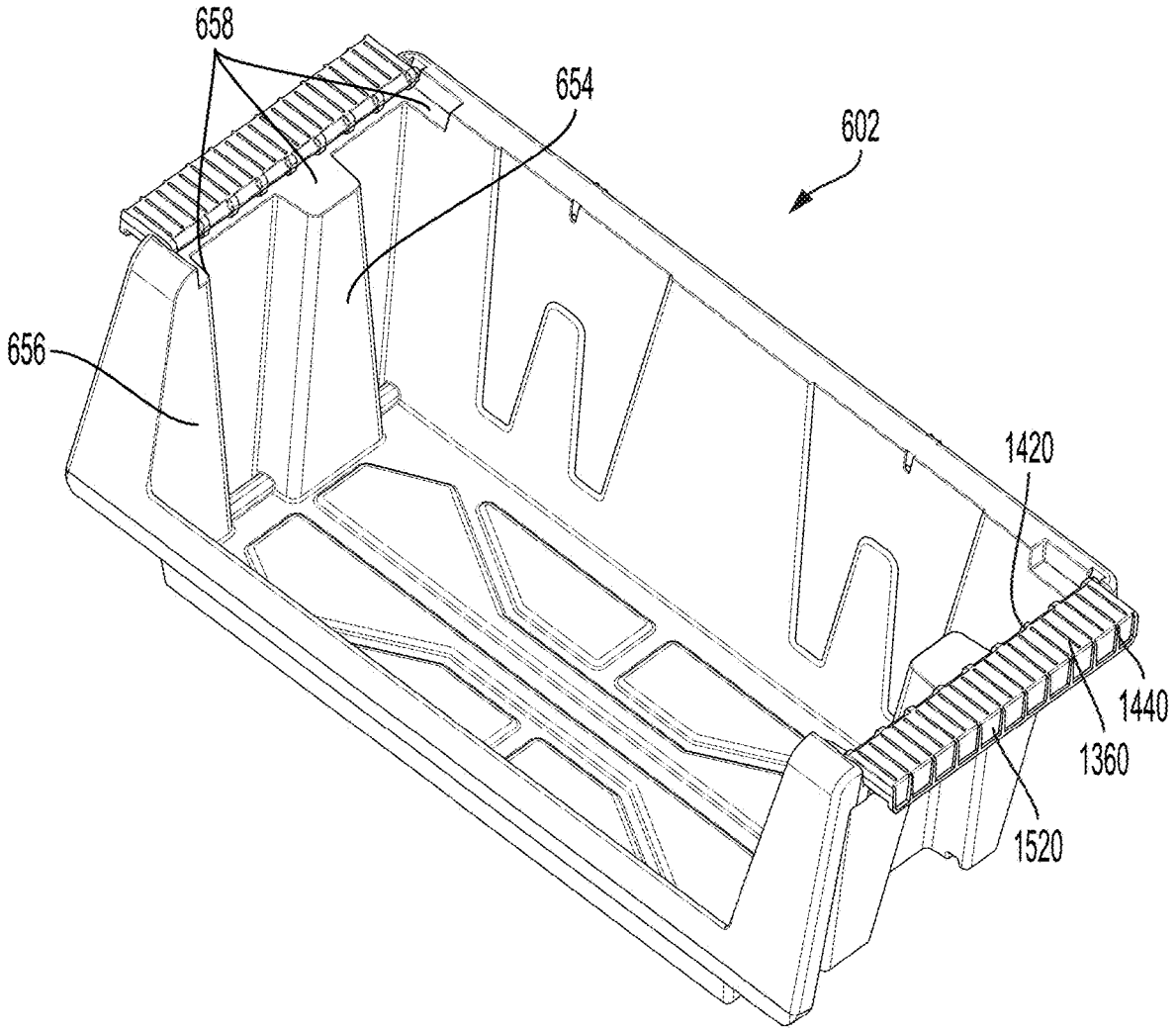
FIG. 10 is a front perspective view of another embodiment of a storage bin.
Figure 11:
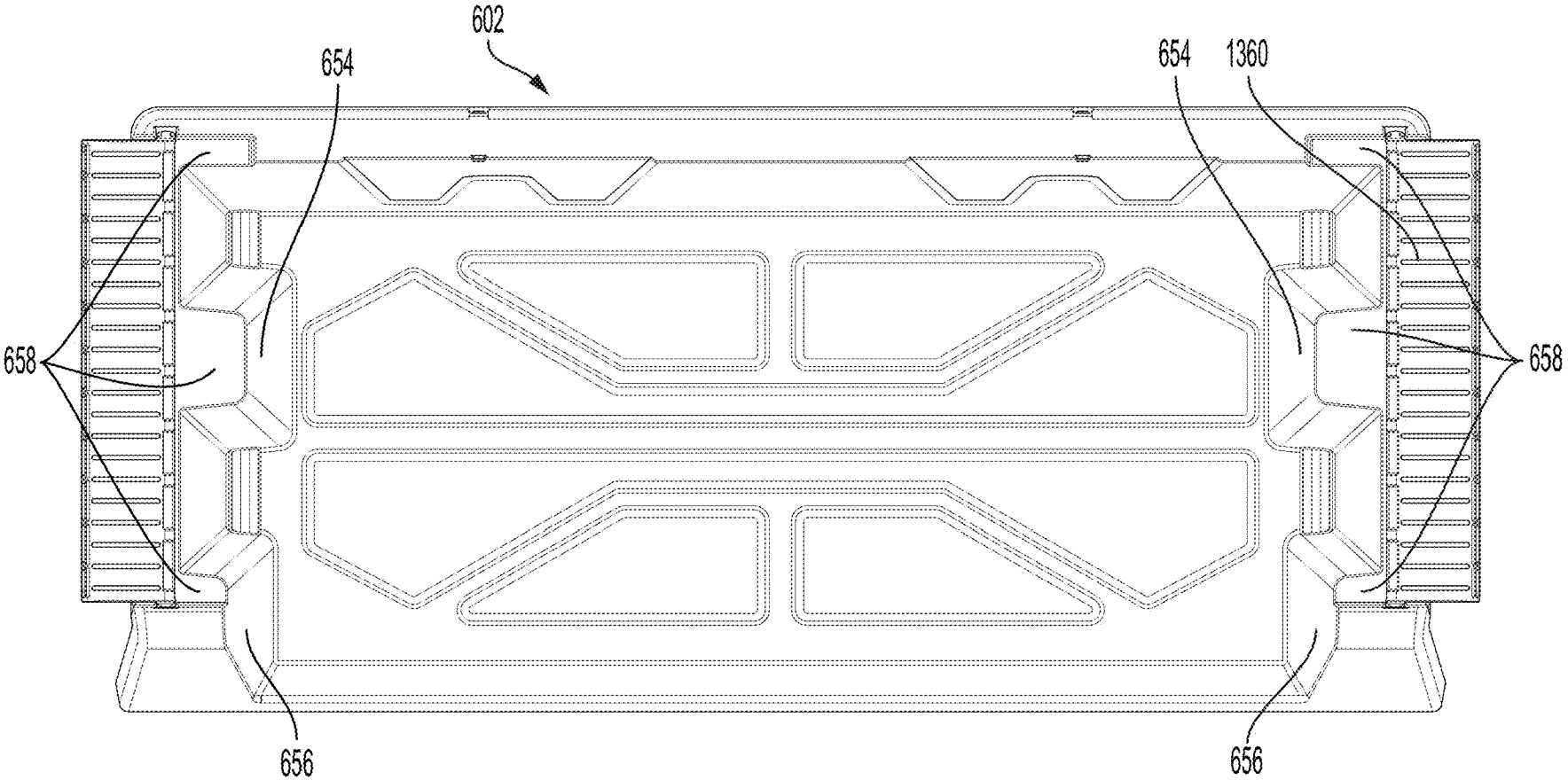
FIG. 11 is a top view of the storage bin of FIG. 10.
Figure 12:
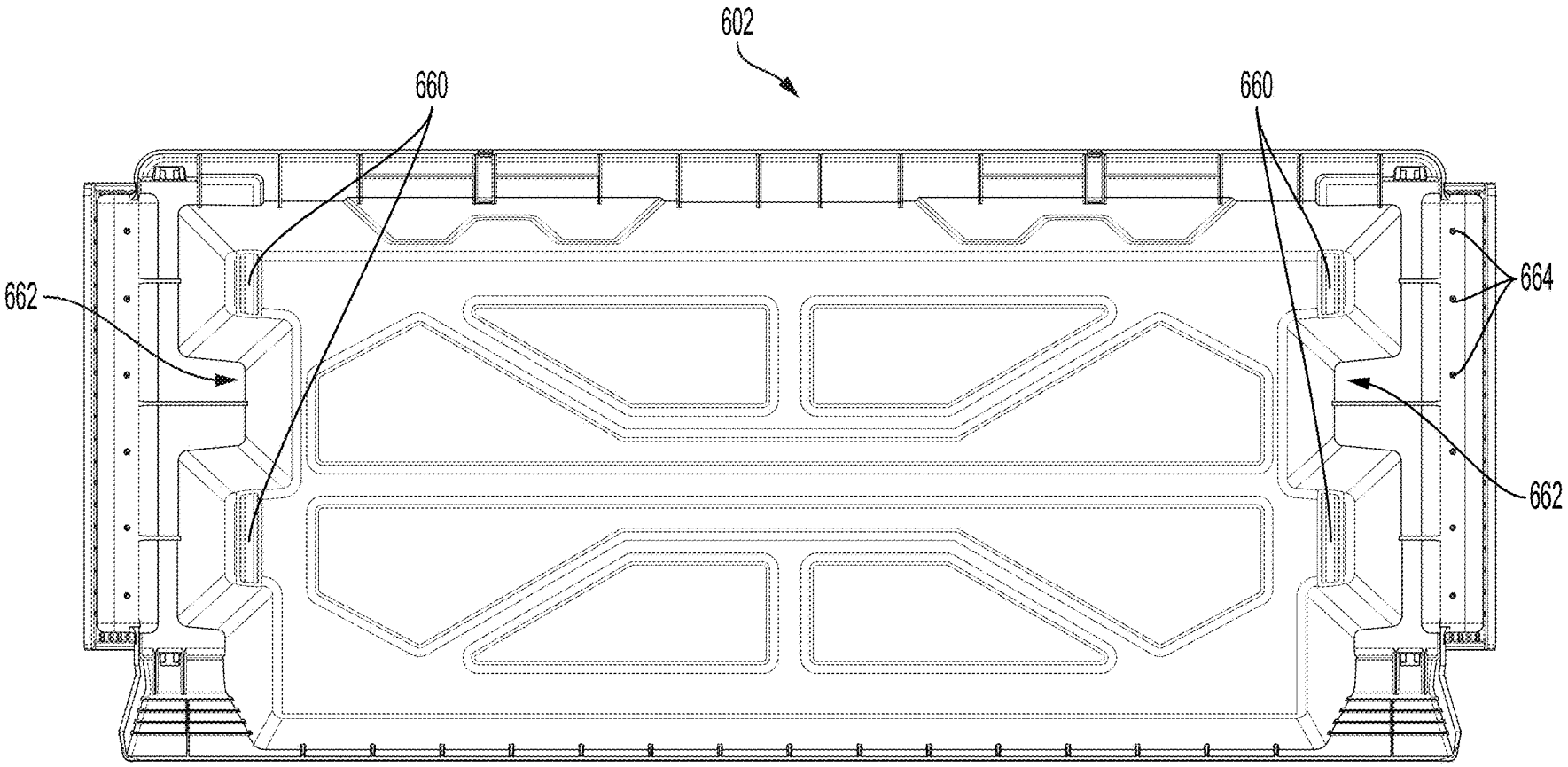
FIG. 12 is a bottom view of the storage bin of FIGS. 10 and 11.
Figure 13:
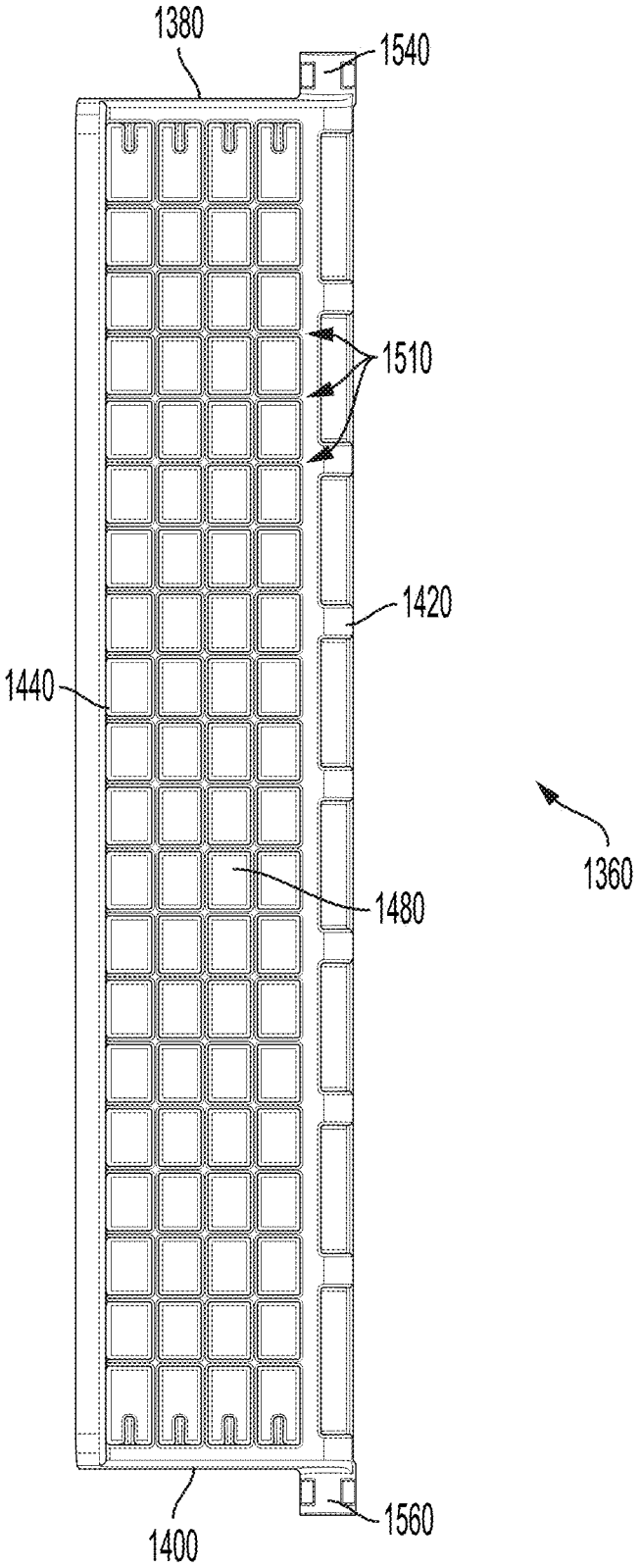
FIG. 13 is a top view of the movable handle of the storage bin of FIGS. 10 and 11 showing the inner surface of the movable handle.

As shown in FIG. 9, the first side 142 has a first pin 154 on the first end 138. The first side 142 further has a second pin 156 on the second end 140. The first pin 154 and the second pin 156 allow the movable handle 136 to connect to the rim 108 of the main body 104. The first pin 154 and the second pin 156 allow the movable handle 136 to function as a flip handle when the movable handle 136 is connected to the main body 104 by allowing the movable handle 136 to be rotatably connected to the main body 104 about an axis of rotation between the opened position and the closed position.

FIGS. 10-13 show another embodiment of a storage bin 602. The storage bin 602 is the same as the storage bin 102 of FIGS. 1 and 2, except as noted herein. As such, the description above with respect to the storage bin 102 also applies to storage bin 602. The stacking surface of storage bin 602 is one of many support surfaces 658. The storage bin 602 includes three support surfaces 658 adjacent each of the movable handles 1360. The three support surfaces 658 adjacent each of the movable handles 1360 comprise a primary support surface adjacent the rim on the central platform 654, a secondary support surface adjacent the rim and the rear wall, and a tertiary support surface closer to the front wall. The primary support surface is spaced between the secondary and tertiary support surfaces. The secondary support surface may be built into the rim of the main body. Together, each of the support surfaces 658 are configured to support the movable handle 1360 in the opened position when the storage bin is in a stacked arrangement with the second storage bin.

The storage bin 602 has slots 660 and a central channel 662. The central channel is opposite the central platform and functions the same way as the channel 122 functions with the platform 116. Additionally, drainable holes 164 (see FIG. 12) are in each of the built-in handles.

Each movable handle 1360 has a first end 1380, a second end 1400, a first side 1420, and a second side 1440. Adjacent the second side 1400 of the movable handle 1360 is the flange. The inner surface 1480 of the movable handle 1360 also has a plurality of ribs 1510 that run from the first side 1420 to the second side 1440. The inner surface 1480 of the movable handle 1360 does not have a central recess, but instead has a plurality of cross-sectional ribs that run from the first end 1380 to the second end 1400 and run perpendicular to the ribs 1510. The ribs 1510 and cross-sectional ribs provide additional stability of the movable handle 1360. The first side 1420 has a first pin 1540 on the first end 1380. The first side 1420 further has a second pin 1560 on the second end 1400. The first pin 1540 and the second pin 1560 allow the movable handle 1360 connect the movable handle 1360 to the rim 108 of the main body 104. The first pin 1540 and the second pin 1560 allow the movable handle 1360 to function as a flip handle when the movable handle 1360 is connected to the main body 104 by allowing the movable handle 1360 to be rotatably connected to the main body 104 about an axis of rotation between the opened position and the closed position.

Figure 14:
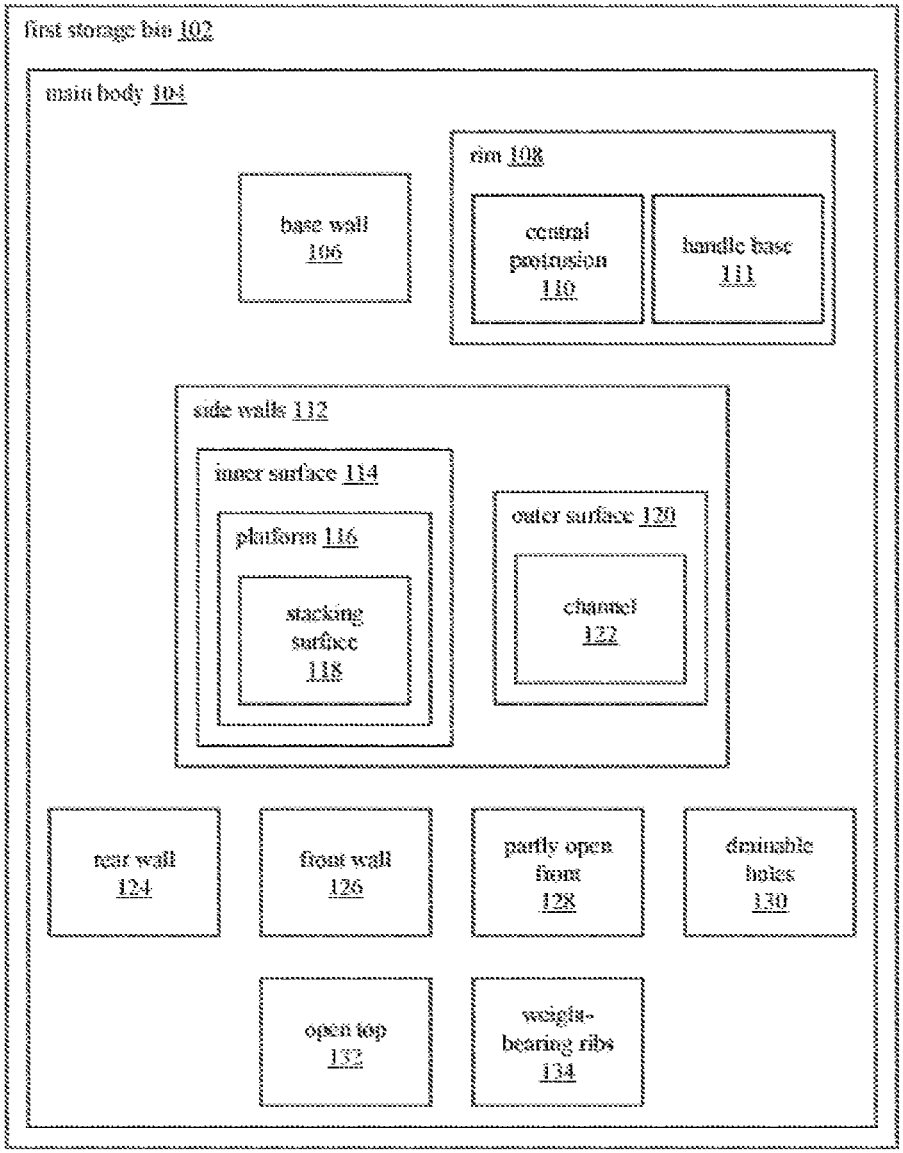
FIG. 14 is a block diagram illustrating a first storage bin, according to some embodiments of the present disclosure.
Figure 15:
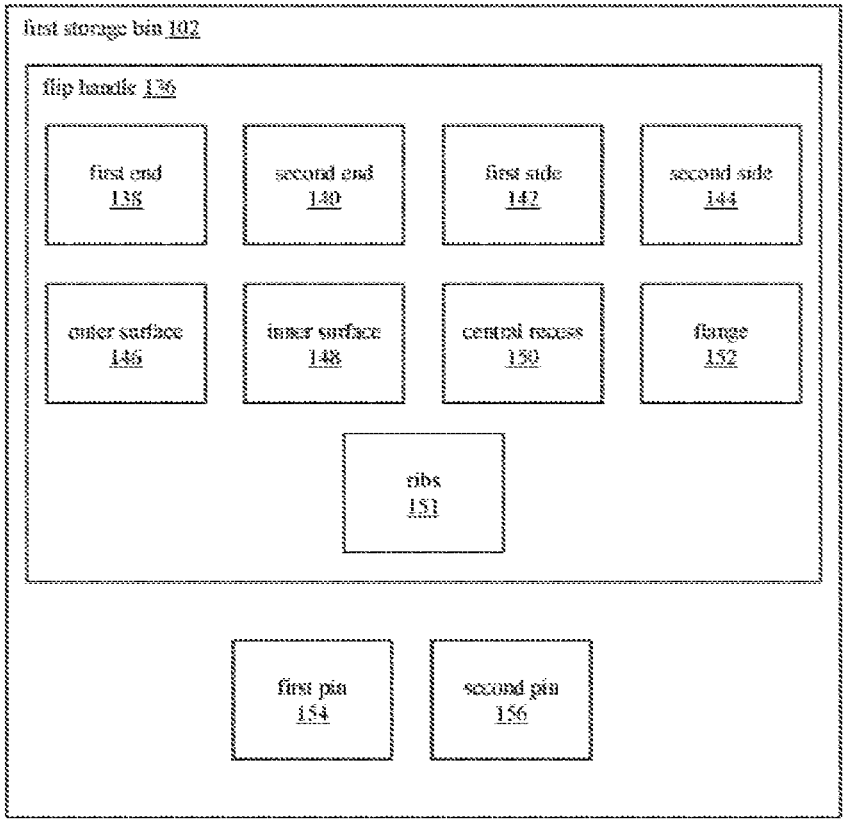
FIG. 15 is a block diagram extending further illustrating the first storage bin, according to some embodiments of the present disclosure.

FIGS. 14 to 15 are block diagrams that describe a storage bin 102, also referred to herein as a first storage bin 102 for use in either a stacked arrangement 200 or a nested arrangement of the storage bins 102, according to some embodiments of the present disclosure. Although the arrangements are described herein with respect to a pair of the storage bins 102, one of ordinary skill in the art should appreciated that any suitable number of the storage bins 102 may be stacked or nested within the scope of the present disclosure, as desired.

The first storage bin 102 may include a main body 104 with a flip handle 136 attached to the rim 108. A first pin 154 may be disposed at the first end 138 of the flip handle 136, and a second pin 156 may be disposed at the second end 140 of the flip handle 136. The main body 104 may include a base wall 106, a rim 108, a pair of side walls 112 that may be spaced opposed, a rear wall 124, a front wall 126, an open top 132, a partly open front 128, a plurality of weight-bearing ribs 134, and a plurality of drainable holes 130.

With continued reference to FIGS. 14 and 15, the rim 108 may include a central protrusion 110 and a handle base 111. The pair of side walls 112 may include an inner surface 114 and an outer surface 120. The inner surface 114 may have a platform 116 formed thereon. The platform 116 may include a stacking surface 118 that is disposed adjacent to the rim 108. The outer surface 120 may include a channel 122 disposed opposite the platform 116.

With further reference to FIGS. 14 and 15, the base wall 106, the pair of side walls 112, the rear wall 124, and the front wall 126 may together define the open top 132 of the main body 104. The rim 108 may be formed by the side walls 112 and rear wall 124, for example. The handle base 111 may extend outwardly from the rim 108 of each of the side walls 112.

In certain embodiments, as also shown in FIGS. 14 and 15, the flip handle 136 may include a first end 138, a second end 140, a first side 142, a second side 144, an outer surface 146, an inner surface 148, a central recess 150, and a flange 152. The central recess 150 is formed in the inner surface 148 of the flip handle 136. The flange 152 is disposed at the second side 144 of the flip handle 136.

Further referring to FIGS. 14 and 15, the flip handle 136 may also include a plurality of ribs 151. The ribs 151 extend between the first side 142 and the second side 144 on the inner surface 148 of the flip handle 136. The flip handle 136 may be rotatably connected to the main body 104 about an axis of rotation between an opened position and a closed position. The flip handle 136 in the opened position may permit a stacked arrangement of the first storage bin 102 with a second storage bin.

In some embodiments, and with renewed reference to FIGS. 14 and 15, the flip handle 136 in the closed position may permit a nested arrangement of the first storage bin 102 with the second storage bin. Importantly, both the stacked arrangement and the nested arrangement may be permitted without a lateral offset between the first storage bin 102 and the second storage bin being necessary.

In certain embodiments, referring again to FIGS. 14 and 15, the first pin 154 and the second pin 156 may together define the axis of rotation. The flip handle 136 may be rotatably connected to the main body 104 with the first pin 154 at the first end 138 of the flip handle 136 and the second pin 156 at the second end 140 of the flip handle 136.

In yet additional embodiments, the central protrusion 110 may be disposed on the rim 108 adjacent to the first side 142 of the flip handle 136 where in the opened position. It should be appreciated that the central protrusion 110 cooperates with the central recess 150 where the flip handle 136 may be in the closed position. Also, the flange 152 may be configured to support the second storage bin where the flip handle 136 may be in the opened position and the first storage bin 102 and the second storage bin may be in the stacked arrangement.

Figure 16:
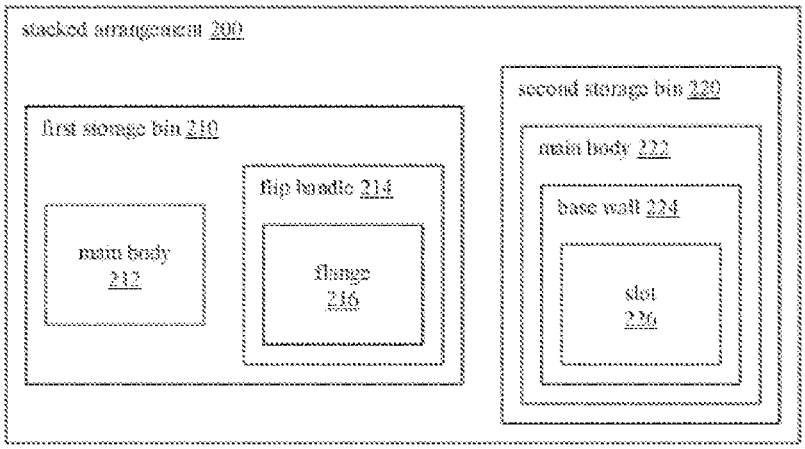
FIG. 16 is a block diagram illustrating a stacked arrangement, according to some embodiments of the present disclosure.

FIG. 16 is a block diagram that describes a stacked arrangement 200, according to some embodiments of the present disclosure. In some embodiments, the stacked arrangement 200 may include a first storage bin 210 (similar or like structure of the first storage bin 210 and accompanying features being as described hereinabove with respect to the first storage bin 102 and accompanying features) and the second storage bin 220. The first storage bin 210 may include a main body 212 and a flip handle 214, for example. The flip handle 214 may include a flange 216. The second storage bin 220 may include a main body 222 with a base wall 224. The base wall 224 may include a slot 226 formed in the base wall 224.

In some embodiments, the second storage bin 220 may be placed on the first storage bin 210 to provide the stacked arrangement 200. The flip handle 214 of the first storage bin 210 may be in an opened position. Importantly, the second storage bin 220 may be stacked on the first storage bin 210 without a lateral offset between the first storage bin 210 and the second storage bin 220. The slot 226 of the base wall 224 of the second storage bin 220 may also receive the flange 216 of the flip handle 214 of the first storage bin 210. The main body 222 of the first storage bin 210 may contact the second storage bin 220 at one area along the slot 226 of the second storage bin 220 and at four areas around base wall of the second storage bin 220.

Figure 17:
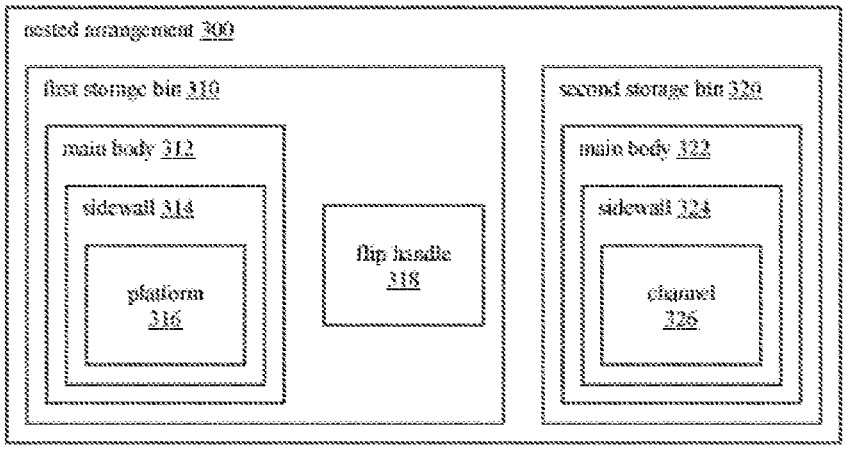
FIG. 17 is a block diagram illustrating a nested arrangement, according to some embodiments of the present disclosure.

FIG. 17 is a block diagram that describes a nested arrangement 300, according to some embodiments of the present disclosure. In some embodiments, the nested arrangement 300 may include a first storage bin 310 (similar or like structure of the first storage bin 310 and accompanying features being as described hereinabove with respect to the first storage bin 102, 210 and accompanying features) and a second storage bin 320 (similar or like structure of the second storage bin 320 and accompanying features being as described hereinabove with respect to the second storage bin 220 and accompanying features). The first storage bin 310 may include a main body 312 with and a flip handle 318. The main body 312 may include a sidewall 314. The sidewall 314 may include a platform 316. The second storage bin 320 may include a main body 322 with a sidewall 324. The sidewall 324 may include a channel 326.

In some embodiments, the second storage bin 320 may be placed on the first storage bin 310 to provide the nested arrangement 300. The flip handle 318 of the first storage bin 310 may be in the closed position. The second storage bin 320 may be nested in the first storage bin 310 without a lateral offset between the first storage bin 310 and the second storage bin 320. The platform 316 of the first storage bin 310 may be selectively slidably disposed within the channel 326 of the second storage bin 320.

Figure 18:
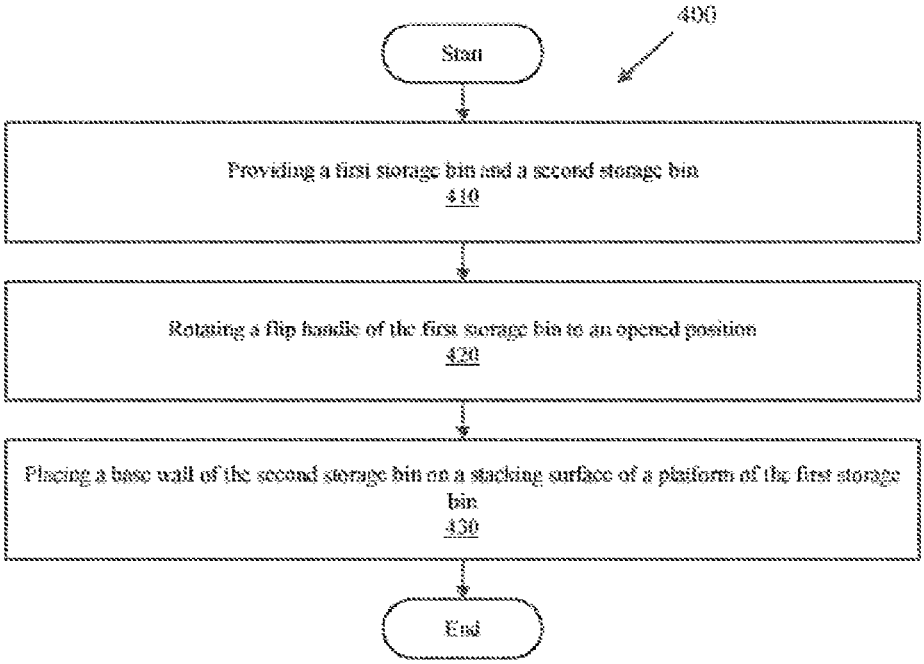
FIG. 18 is a flowchart illustrating a method for stacking storage bins, according to some embodiments of the present disclosure.

FIG. 18 is a flowchart that describes a stacking method 400 for stacking storage bins, for example, to provide the stacked arrangement 200, according to some embodiments of the present disclosure. In some embodiments, at a step 410, the stacking method 400 may include providing a first storage bin and a second storage bin. At a step 420, the stacking method 400 may include rotating a flip handle of the first storage bin to an opened position. At a step 430, the stacking method 400 may include placing a base wall of the second storage bin on a flip handle and a stacking surface 118 of a platform of the first storage bin. Steps of the stacking method 400 for stacking may include steps 410 to 430. The base wall of the second storage bin may be supported by the flip handle of the first storage bin without there being a lateral offset between the first storage bin and the second storage bin upon provision of the stacked arrangement 200 according to the stacking method 400.

Figure 19:
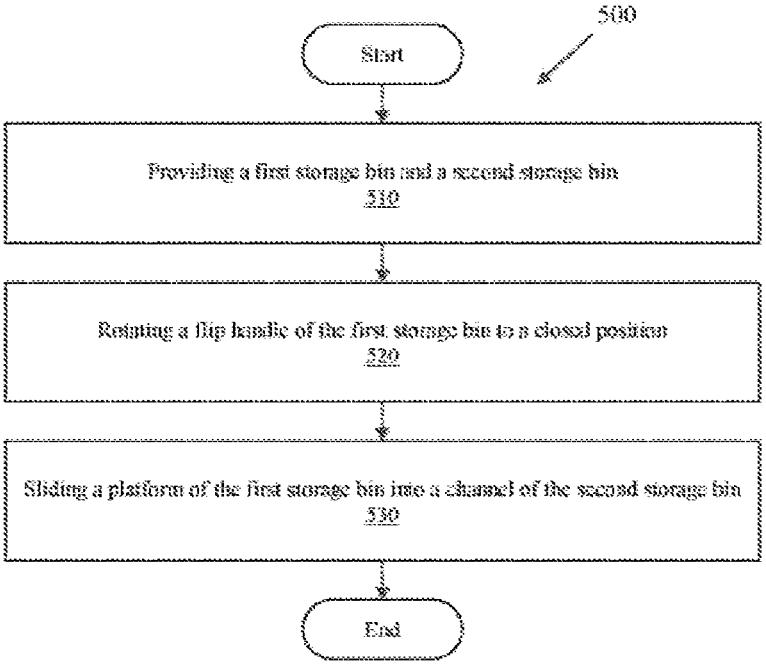
FIG. 19 is a flowchart illustrating a method for nesting storage bins, according to some embodiments of the present disclosure.

FIG. 19 is a flowchart that describes a nesting method 500, for example, to provide the nested arrangement 300 of FIG. 17, according to some embodiments of the present disclosure. In some embodiments, at a step 510, the nesting method 500 may include providing a first storage bin and a second storage bin. At a step 520, the nesting method 500 may include rotating a flip handle of the first storage bin to a closed position. At a step 530, the nesting method 500 may include sliding a platform of the first storage bin into a channel 326 of the second storage bin. Steps of the nesting method 500 may include the steps 510 to 530. A base wall of the second storage bin may be disposed adjacent a base wall of the first storage bin without there being a lateral offset between the first storage bin and the second storage bin upon provision of the nested arrangement 300 according to the nesting method 500.

Figure 20:
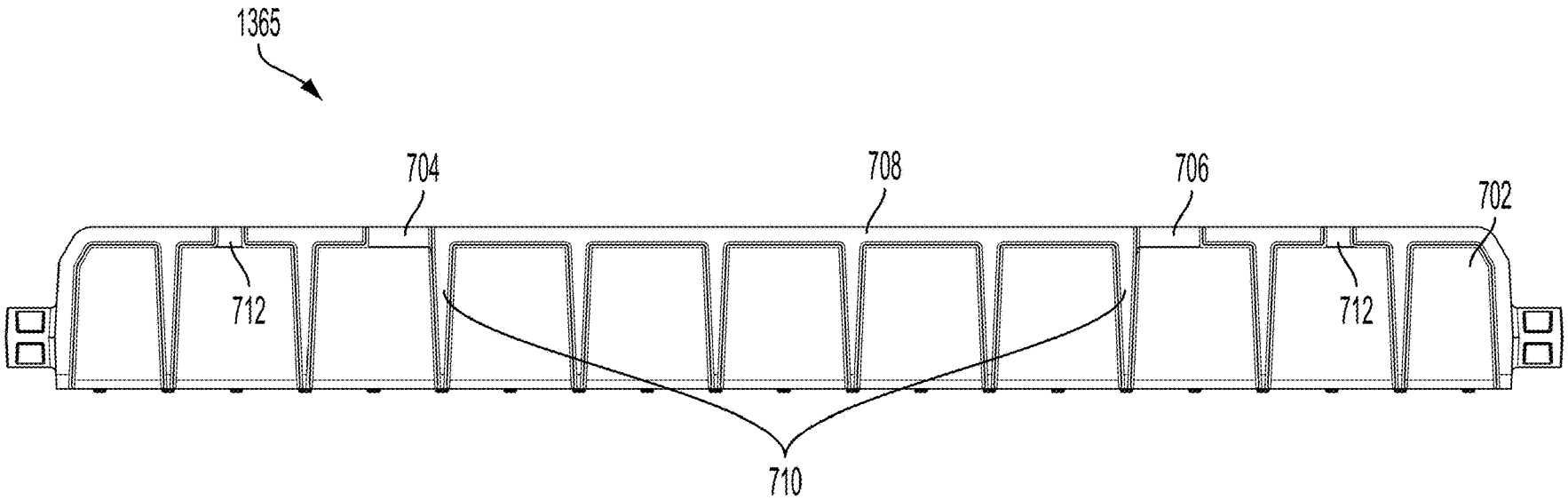
FIG. 20 is a front view of one embodiment of a movable handle.
Figure 21:
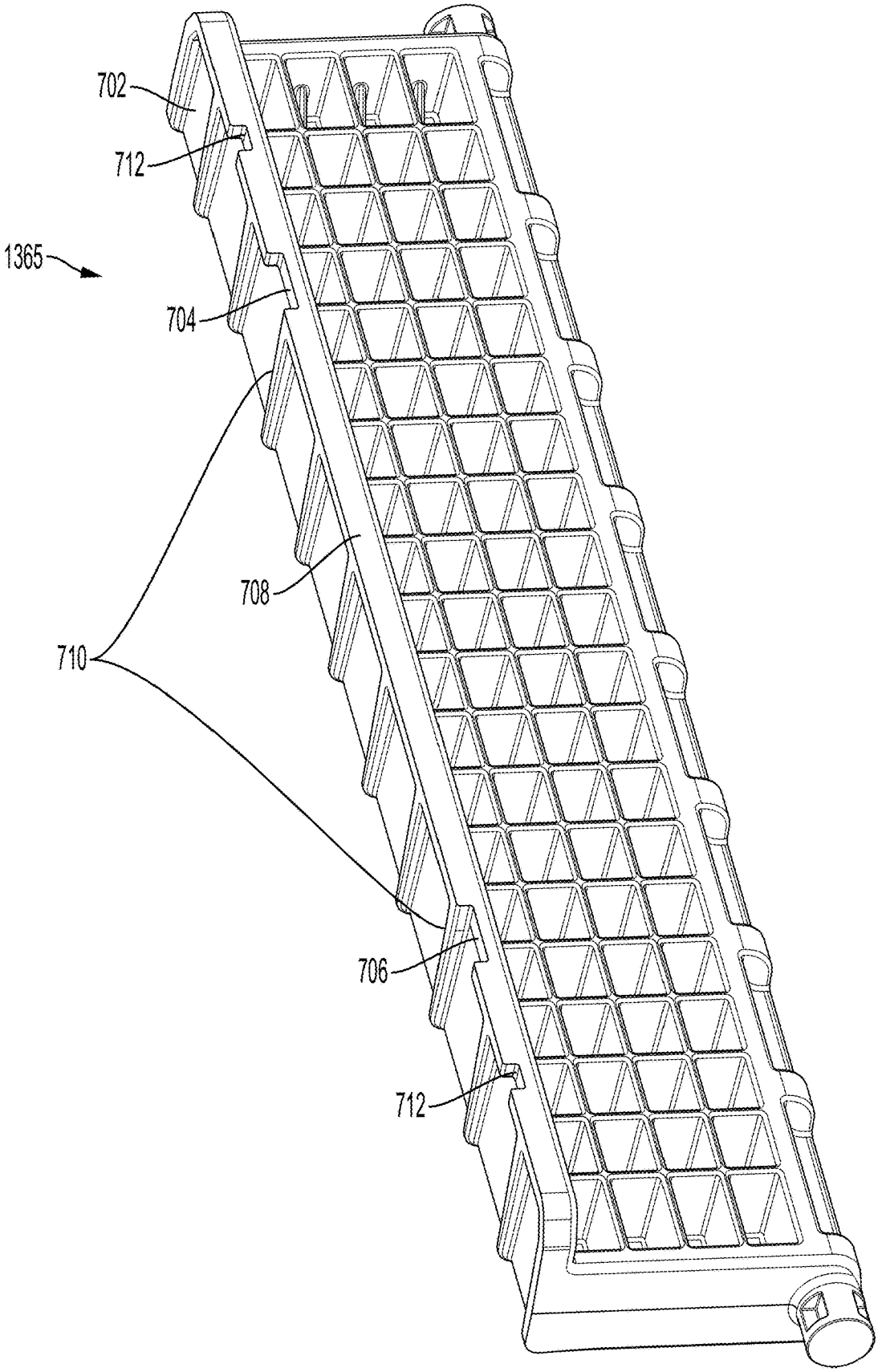
FIG. 21 is a perspective view of the inner surface of the embodiment of the movable handle of FIG. 20.

FIGS. 20 and 21 show another embodiment of a movable handle 1365. The movable handle 1365 may be the same as the other movable handles referenced herein, except as noted herein. With reference to FIGS. 20 and 21, another embodiment of a movable handle 1365 has a flange 702 that has a first handle locking element 704 and a second handle locking element 706 in an outer lip 708 of the flange 702. Each of the first and second handle locking elements 704 and 706 may be partially defined on one side by protruding row 710 that extends the length of the flange 702. There may be a plurality of additional protruding rows 710 that extend the length of the flange 702. The flange may have one or more handle locking elements 712 in the outer lip 708. The additional handle locking elements may be a different size than the handle locking elements 704 and 706.

Figure 22:
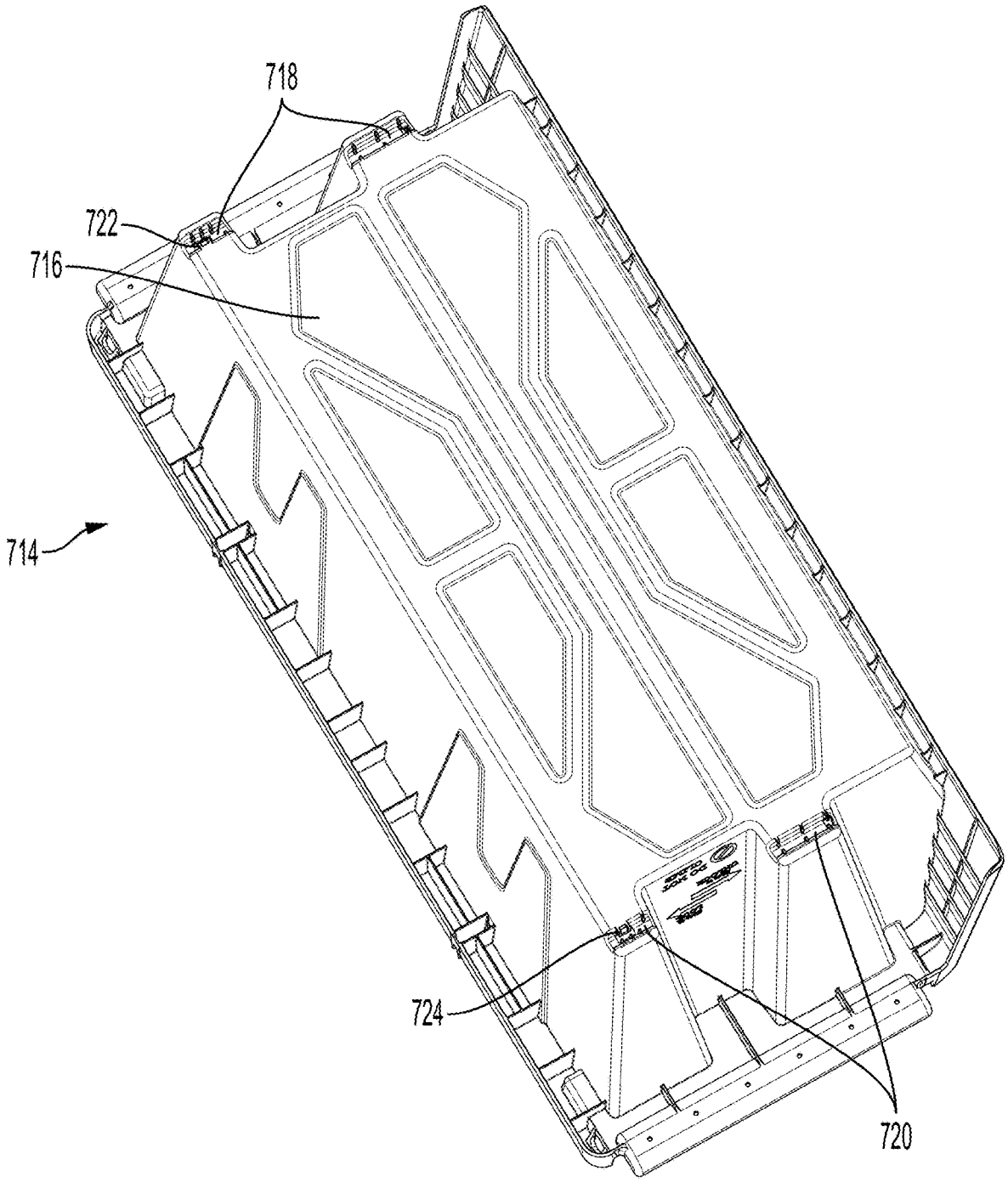
FIG. 22 is a bottom perspective view of one embodiment of a storage bin.
Figure 23:
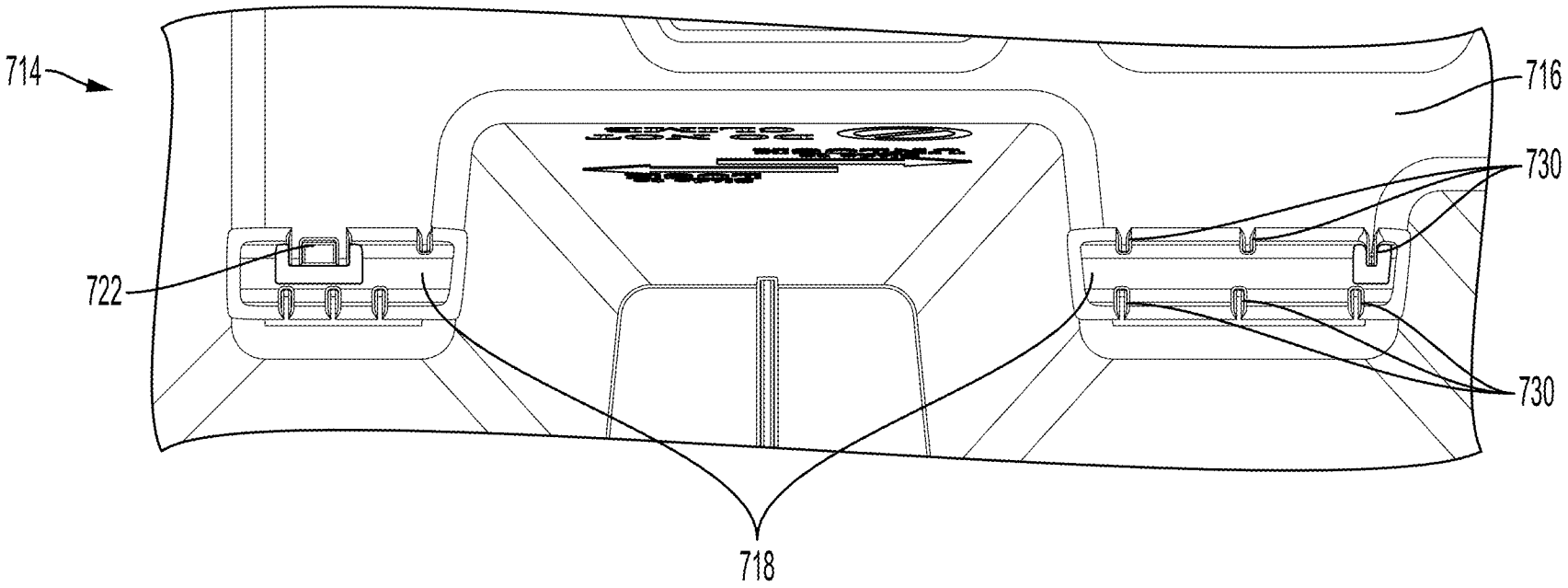
FIG. 23 is a sectional view of the bottom of the embodiment of the storage bin of FIG. 22.
Figure 24:
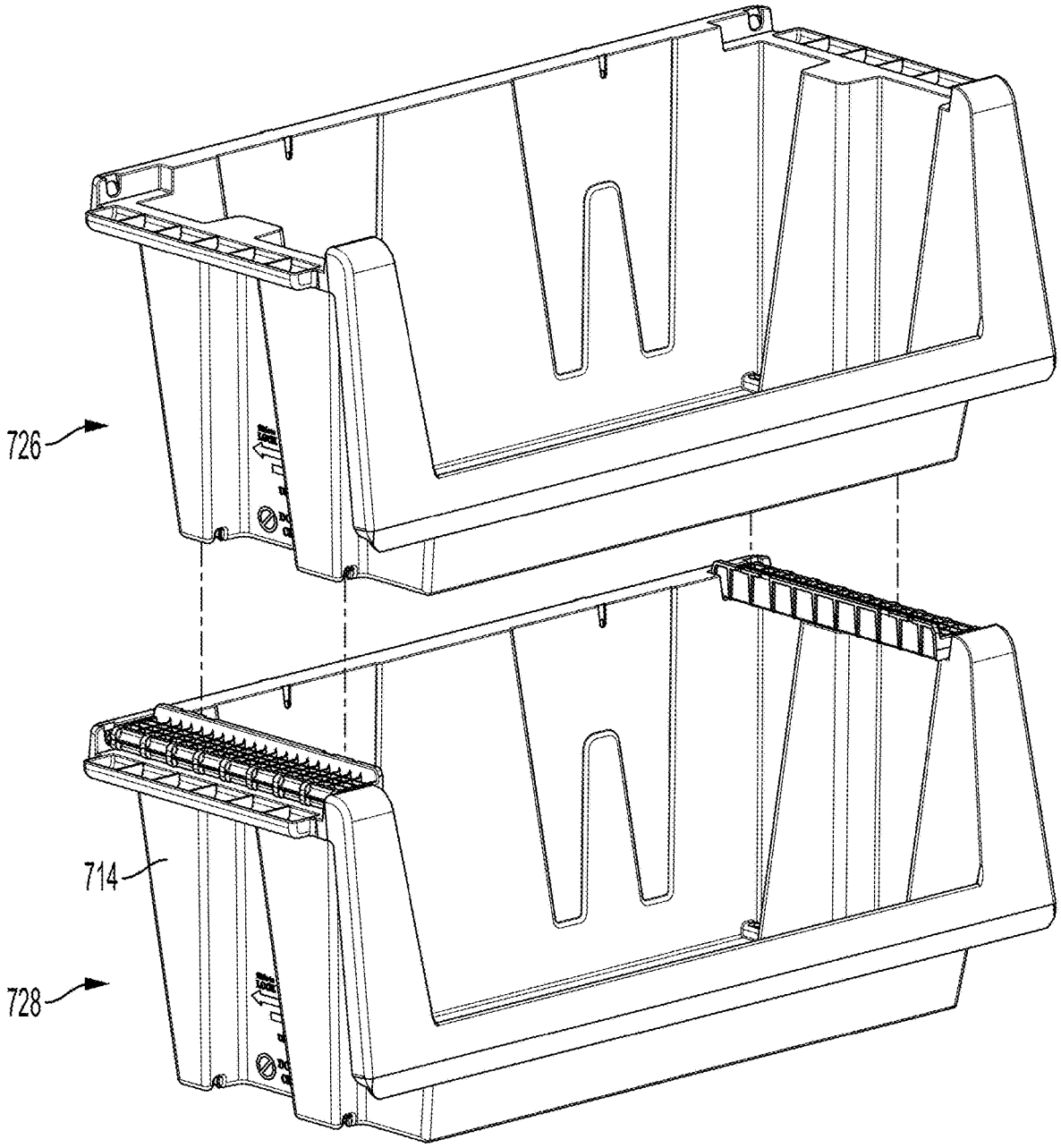
FIG. 24 is an exploded view of the embodiment of the storage bin of FIG. 22 in a stacked arrangement with another embodiment of the storage bin of FIG. 22.

The movable handle 1365 in FIGS. 20 and 21 used with the embodiment of a main body 714 referenced in FIGS. 22-24. The main body 714 may be the same as the other main bodies referenced herein, except as noted herein. There, the base wall 716 has a first slot 718 and a second slot 720. The first slot 718 has a first base locking element 722 that projects downwardly from the first slot 718. The second slot 720 has a second base locking element 724 that projects downwardly from the second slot. Each of the first slot 718 and the second slot 720 may have a hole into the interior of the first storage bin 726.

Figure 26:
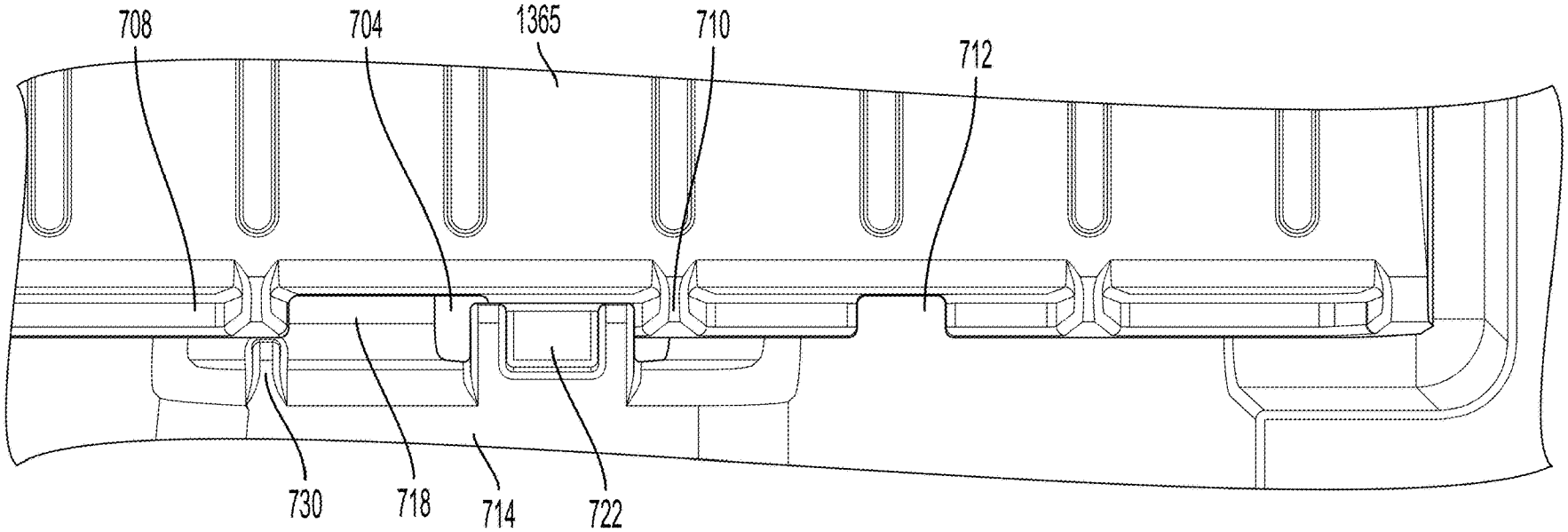
FIG. 26 is a sectional bottom view of the storage bin of FIG. 22 a stacked arrangement with another embodiment of the storage bin of FIG. 22.
Figure 27:
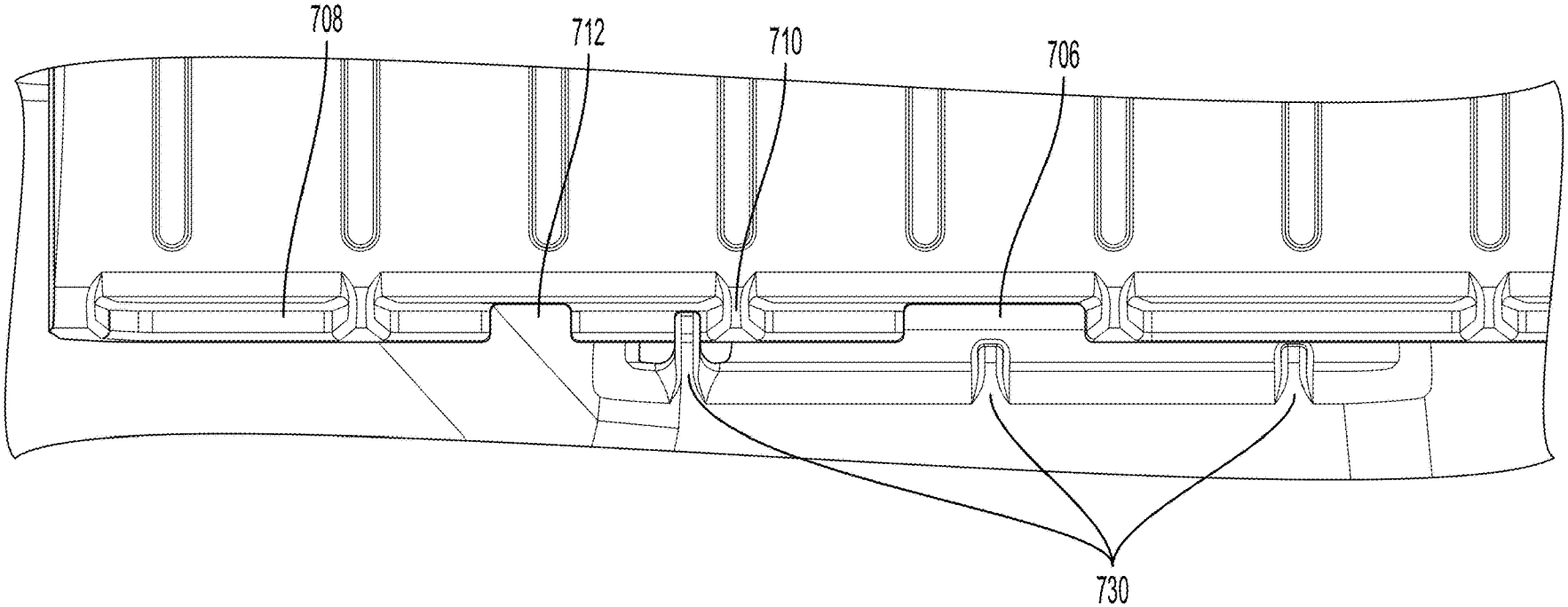
FIG. 27 is a sectional bottom view of the storage bin of FIG. 22 a stacked arrangement with another embodiment of the storage bin of FIG. 22.

In the stacked position, as shown in FIGS. 24, 26 and 27, wherein a first storage bin 726 is in a stacked arrangement with a second storage bin 728, the first base locking element 722 of the second storage bin 728 is configured to be received by the first handle locking element 704 of the first flange 702 of the second storage bin 728. The first base locking element 722 may be received by the first handle locking element 704 by being inserted into the first handle locking element 704. Once the first base locking element 722 is inserted in the first handle locking element 704, the first storage bin 726 is prevented from lateral movement relative to the second storage bin 728 because the first base locking element 722 is prevented from lateral movement by the outer lip 708 of the flange. Additionally, the first base locking element 722 may be prevented from moving laterally by the protruding row 710 that extends the length of the flange. For example, the first base locking element 722 may be inserted into the first handle locking element 704 and abut both the outer lip 708 and the protruding row 710. When the first storage bin is stacked atop the second storage bin, the first storage bin may be moveable forward and rearward relative to the second storage bin between a locked position and an unlocked position. Additionally, the first storage bin may be moved laterally relative to the second storage bin between a locked and unlocked position. In the unlocked position, the first storage bin can be lifted off the second storage bin because there is nothing preventing the first storage bin from being lifted upward off the second storage bin. In the locked position, the first base locking element 722 of the first storage bin inter-engages the first handle locking element 704 of the second storage bin. This inter-engagement that facilitates the locking position prevents the first storage bin from being removed from the second storage bin. For example, the outer lip 708 may prevent the first storage bin from being removed from the second storage bin while the bins are in the locked position. The first base locking element 722 may further be preventing by the outer lip 708 of the flange from moving in an upward position and may prevent the first storage bin from being removed from the second storage bin in the locked position. In the stacked arrangement, the second base locking element 724 of the first interlocking bin may also be configured to be received by the second handle locking element 706 of the second storage bin 728 in a similar way as described above with the first base locking element 722. For additional security and to prevent forward and rearward movement, both the first base locking element 722 and the second base locking element 724 may each be inserted, respectively, into the first handle locking element 704 and the second handle locking element 706. Additionally, each of the first and second slots 718 and 720 may comprise a plurality of interlocking teeth 730. The plurality of interlocking teeth 730 may assist in creating friction between the flange and the slot so as to further prevent lateral or forward and rearward movement of the first storage bin 726 relative to the second storage bin 728. An interlocking tooth may abut against a protruding row 710 to create additional friction or prevent movement. One or more of the plurality of interlocking teeth 730 may extend longer than the other interlocking teeth and further prevent lateral and forward and rearward movement of the first storage bin 726 relative to the second storage bin 728 by engaging with the protruding row 710 and preventing the protruding row from moving laterally or forward and rearward in the stacked position. One or more of the plurality of interlocking teeth 730 may engage with the outer lip 708 to releasably couple the outer lip 708 to the first interlocking tooth, thereby preventing the first and second storage bins from being released from a stacked arrangement. The plurality of interlocking teeth 730 may further facilitate the locking position by preventing the first storage bin from being removed from the second storage bin. For example, the plurality of interlocking teeth 730 may be prevented from upward movement by the outer lip 708 of the flange in the locked position. In addition, each of the first handle locking elements 704, the second handle locking elements 706 and the one or more handle locking elements 712 may act as a catch to receive the first and second handle locking elements in the locked position.

Figure 25:
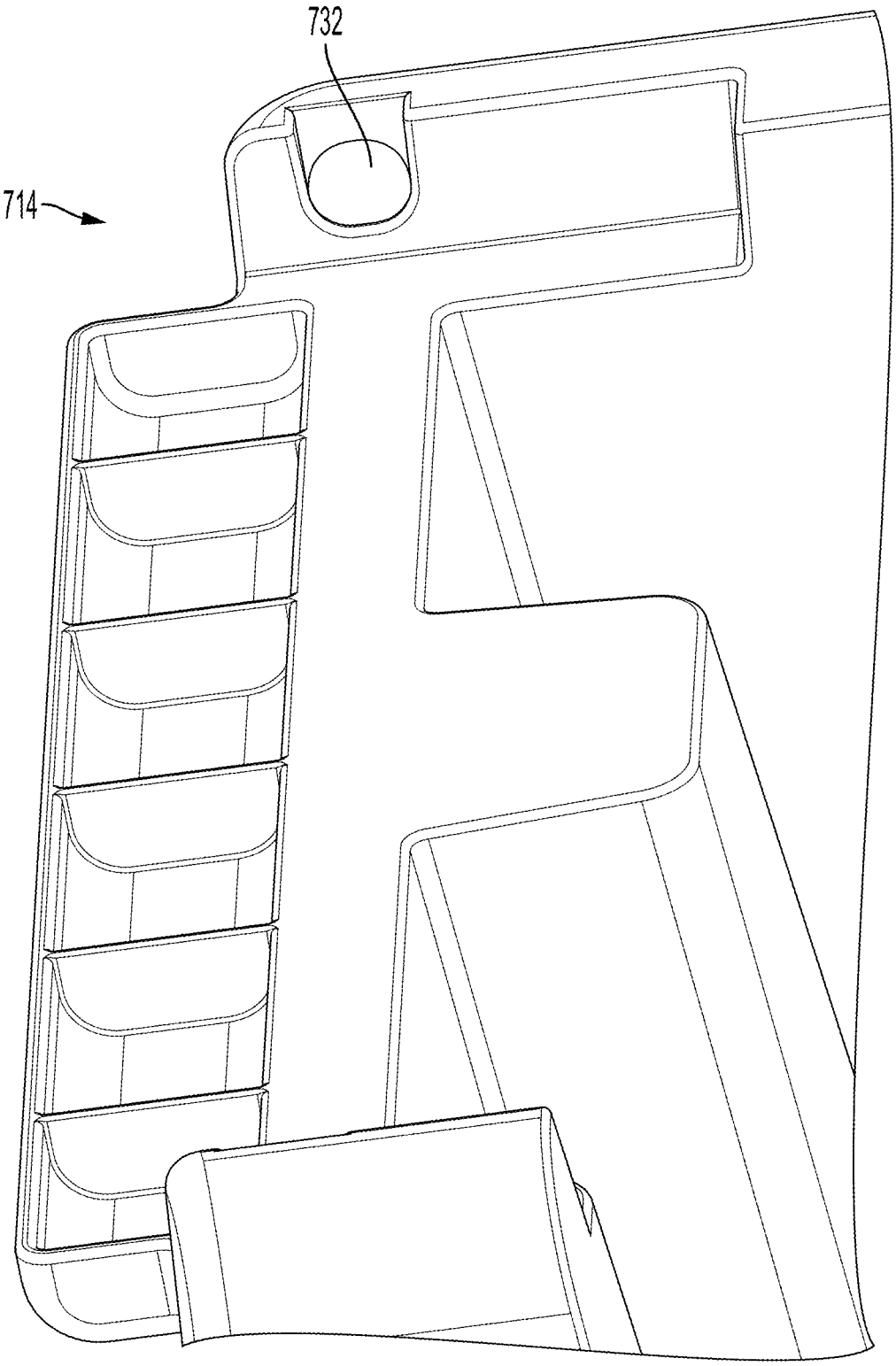
FIG. 25 is a sectional side perspective view of the storage bin of FIG. 22.

Certain embodiments of the stackable bin may further have a first set of oblong holes configured to receive a first pin 154 on the first end 138 of the movable handle 136, and configured to receive the second pin 156 on the second end 140 of the moveable handle 136. The connection of the first pin 154, the second pin 156 and the first set of oblong holes allow the moveable handle 136 to be connected to the main body 104 to define the axis of rotation. In a similar way, a second set of oblong holes may be configured to receive a first pin and a second pin of a second movable handle in order to connect the second movable handle to the main body to define the axis of rotation. An example of an oblong hole that that may define one of the oblong holes 732 in either the first set of oblong holes or second set of oblong holes is shown in FIG. 25. The oblong holes have certain advantages over round holes. Specifically, the oblong holes prevent warping and buckling during manufacturing and while stacking. The advantages are especially considerable in the present invention when the center of gravity of the bins is such to allow for stacking without a vertical offset.

EXAMPLES

Examples of the present disclosure may include a first storage bin, including a main body with a base wall. Examples may also include a rim having built-in handles. Examples may also include a central protrusion formed on the rim.

Examples may also include a pair of side walls that may be spaced opposed, each of the side walls having an inner surface with a platform having a stacking surface disposed adjacent to the rim. Examples may also include an outer surface with a channel disposed opposite the platform. Examples may also include a rear wall, a front wall, an open top, a partly open front, and a handle base. The handle base may have a plurality of weight-bearing ribs and a plurality of drainable holes.

In some examples, the base wall, the pair of side walls, the rear wall, and the front wall together define the open top of the main body. In some examples, the rim may be formed by the side walls and rear wall.

In further examples, the handle base extends outwardly from the rim of each of the side walls. Examples may also include a flip handle attached to the rim, the flip handle having a first end and a second end, and a first side and a second side. The flip handle may also have an outer surface and an inner surface. Examples may also include a plurality of ribs extending between the first side and the second side on the inner surface of the flip handle. Examples may also include a central recess formed in the inner surface of the flip handle.

Examples may also include a flange at the second side of the flip handle. Examples may also include a first pin disposed at the first end of the flip handle. Examples may also include a second pin at the second end disposed at the second end of the flip handle. In some examples, the flip handle may be rotatably connected to the main body about an axis of rotation between an opened position and a closed position.

In yet other examples, the flip handle in the opened position permits a stacked arrangement of the first storage bin with a second storage bin. In some examples, the flip handle in the closed position permits a nested arrangement of the first storage bin with the second storage bin. In some examples, both the stacked arrangement and the nested arrangement may be permitted without a lateral offset between the first storage bin and the second storage bin.

In some examples, the first pin and the second pin together define the axis of rotation. In some examples, the flip handle may be rotatably connected to the main body with the first pin at the first end of the flip handle and the second pin at the second end of the flip handle. In some examples, the central protrusion may be disposed on the rim adjacent to the first side of the flip handle where in the opened position, and the central protrusion cooperates with the central recess where the flip handle may be in the closed position. In some examples, the flange may be configured to support the second storage bin where the flip handle may be in the opened position and the first storage bin and the second storage bin may be in the stacked arrangement.

Examples of the present disclosure may also include a stacked arrangement, including a first storage bin having a main body and a flip handle with a flange. Examples may also include a second storage bin having a main body with a base wall with a slot formed in the base wall. In some examples, the second storage bin is placed on the first storage bin. In some examples, the flip handle of the first storage bin may be in an opened position.

In some examples, the second storage bin may be stacked on the first storage bin without a lateral offset between the first storage bin and the second storage bin. In further examples, the slot of the base wall of the second storage bin receives the flange of the flip handle of the first storage bin. In additional examples, the main body of the first storage bin contacts the second storage bin at one area along the slot of the second storage bin and at four areas around base wall of the second storage bin.

Examples of the present disclosure may also include a nested arrangement, including a first storage bin having a main body with a sidewall having a platform. Examples may also include a flip handle.

Examples may also include a second storage bin having a main body with a sidewall having a channel. In some examples, the second storage bin may be placed on the first storage bin.

In some examples, the flip handle of the first storage bin may be in the closed position. In some examples, the second storage bin may be nested in the first storage bin without a lateral offset between the first storage bin and the second storage bin. In some examples, the platform of the first storage bin may be selectively slidably disposed within the channel of the second storage bin.

Examples of the present disclosure may also include a method for stacking storage bins, the method including steps of providing a first storage bin and a second storage bin. Examples may also include a step of rotating a flip handle of the first storage bin to an opened position. Examples may also include a step of placing a base wall of the second storage bin on a stacking surface of a platform of the first storage bin. In some examples, the base wall of the second storage bin may be supported by the flip handle of the first storage bin without there being a lateral offset between the first storage bin and the second storage bin.

Examples of the present disclosure may also include a method for nesting storage bins, the method including steps of providing a first storage bin and a second storage bin. Examples may also include a step of rotating a flip handle of the first storage bin to a closed position. Examples may also include a step of sliding a platform of the first storage bin into a channel of the second storage bin. In some examples, a base wall of the second storage bin may be disposed adjacent a base wall of the first storage bin without there being a lateral offset between the first storage bin and the second storage bin.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods may be made within the scope of the present technology, with substantially similar results.

What is claimed is:

1. A first storage bin, comprising:

a main body with a base wall, a first side wall, a second side wall opposite the first side wall, a rear wall, a front wall and a rim, the main body having an open top and a partly open front, the rim being on the side walls and the rear wall, each of the first and second side walls having an inner surface and an outer surface, a platform formed on the inner surface of each of the side walls, and a channel formed on the outer surface of each of the first and second side walls opposite the platform;

a first movable handle attached to the main body adjacent the first side wall;

a second movable handle attached to the main body adjacent the second side wall;

each of the first and second movable handles being connected to the main body and movable between an opened position and a closed position, the movable handles in the opened position permitting a stacked arrangement of the first storage bin with a second storage bin identical to the first storage bin, the movable handles in the closed position permitting a nested arrangement of the first storage bin with the second storage bin, with both the stacked arrangement and the nested arrangement permitted without a lateral offset between the first storage bin and the second storage bin;

the base wall having a first base locking element and a second base locking element, the first movable handle having a first handle locking element, the second movable handle have a second handle locking element, the first and second base locking elements and the first and second handle locking elements being arranged and configured such that when the first storage bin is stacked atop the second storage bin, the first storage bin is movable relative to the second storage bin between a locked position and an unlocked position, the unlocked position being a position in which the first storage bin can be lifted off the second storage bin, the locked position being a position in which the first base locking element of the first storage bin inter-engages the first handle locking element of the second storage bin and the second base locking element of the first storage bin inter-engages the second handle locking element of the second storage bin to prevent the first storage bin from being lifted from the second storage bin.

2. The first storage bin of claim 1:

wherein the first base locking element comprises a first locking projection, the second base locking element comprises a second locking projection, the first handle locking element comprises a first catch, the second handle locking element comprises a second catch, and wherein in the locked position with the second storage bin, the first locking projection of the first storage bin is configured to be received by the catch of the second storage bin, and the second locking projection of the first storage bin is configured to be received by the second catch of the second storage bin.

3. The first storage bin of claim 2, wherein each of the first movable handle and the second movable handle is rotatably connected to the main body about an axis of rotation between the opened position and the closed position.

4. The first storage bin of claim 3, wherein the main body comprises a first set of oblong holes and a second set of oblong holes, the first movable handle comprises first and second ends projecting into the oblong holes of the first set to enable the first movable handle to be rotatably connected to the main body, the second movable handle comprises first and second ends projecting into the oblong holes of the second set to enable the second movable handle to be rotatably connected to the main body.

5. The first storage bin of claim 1, wherein the inner surface of the first side wall includes a first platform, the inner surface of the second wall includes a second platform, the outer surface of the first side wall includes a first channel opposite the first platform, and the outer surface of the second side wall includes a second channel opposite the second platform.

6. The first storage bin of claim 5, wherein the first channel, the second channel, the first platform, and the second platform are pitched from the rim to the base wall, the first channel is configured to receive the first platform of the second storage bin in a nested position, and the second channel is configured to receive the second platform of the second storage bin in a nested position.

7. The first storage bin of claim 5, wherein the first platform has a first stacking surface adjacent the rim, the second platform has a second stacking surface adjacent the rim, the first stacking surface being configured to support the first movable handle in the opened position, and the second stacking surface being configured to support the second movable handle in the opened position, whereby the first and second stacking surfaces are configured to support the second storage bin in the stacked arrangement via the first and second movable handles in the opened positions.

8. The first storage bin of claim 7, wherein the first stacking surface constitutes a first primary support surface, and the second stacking surface constitutes a second primary support surface, the main body further comprising a first secondary support surface spaced from the first primary support surface, and a second secondary support surface spaced from the second primary support surface, the first primary support surface and the first secondary support surface being configured to support the first movable handle in the opened position, and the second primary support surface and the second secondary support surface being configured to support the second movable handle in the opened position.

9. The first storage bin of claim 8, wherein the first secondary support surface and the second secondary support surface are adjacent the rim and the rear wall.

10. The first storage bin of claim 8, further comprising a first tertiary support surface spaced away from the first primary support surface and the first secondary support surface, and a second tertiary support surface spaced away from the second primary support surface and the second secondary support surface, the first tertiary support surface being configured to support the first movable handle in the opened position, and the second tertiary support surface being configured to support the second movable handle in the opened position.

11. The first storage bin of claim 1, wherein each of the first and second movable handles further has a plurality of ribs extending between a first side and a second side on an inner surface of each first and second movable handle.

12. The first storage bin of claim 1, wherein the first movable handle further has a first flange at a second side of the first movable handle, the second movable handle further has a second flange at a second side of the second movable handle, each of the first and second flange configured to support the second storage bin where the first and second movable handles are in the opened position and the first storage bin and the second storage bin are in the stacked arrangement.

13. The first storage bin of claim 12, further comprising a first slot and a second slot in the base wall, the first slot configured to receive the first flange of the first movable handle on the second storage bin where the first storage bin and the second storage bin are in the stacked arrangement, and the second slot configured to receive the second flange of the second movable handle on the second storage bin where the first storage bin and the second storage bin are in a stacked arrangement.

14. The first storage bin of claim 1, wherein the main body further comprises a first handle base extending outwardly from the rim of the first side wall, and a second handle base extending outwardly from the rim of the second side wall.

15. The first storage bin of claim 1, wherein the first storage bin is movable forward and rearward relative to the second storage bin between the locked position and the unlocked position.

16. The first storage bin of claim 1, further comprising first and second slots, each of the first and second slots comprising a plurality of interlocking teeth configured to limit movement of the first storage bin relative to the second storage bin in the locked position.

17. A pair of storage bins, comprising:

a first storage bin and a second storage bin, the first storage bin having a main body with a base wall having a first base locking element and a second base locking element the second storage bin comprising a main body, a first movable handle and a second movable handle, the main body having a first side wall and a second side wall, the first movable handle being attached to the main body adjacent the first side wall, the first movable handle having a first handle locking element, the second movable handle attached to the main body adjacent the second side wall, the second movable having a second handle locking element, each of the first and second movable handles being connected to the main body of the second storage bin and movable between an opened position and a closed position, the movable handles in the opened position permitting a stacked arrangement of the first storage bin atop the second storage bin, the movable handles in the closed position permitting a nested arrangement of the first storage bin within the second storage bin, with both the stacked arrangement and the nested arrangement permitted without a lateral offset between the first storage bin and the second storage bin;

wherein the first storage bin is configured to be placed in a stacked arrangement on the second storage bin, wherein in the stacked arrangement, the first and second base locking elements and the first and second handle locking elements are arranged and configured such that the first storage bin is movable relative to the second storage bin between a locked position and an unlocked position, the unlocked position being a position in which the first storage bin can be lifted off the second storage bin, the locked position being a position in which the first base locking element inter-engages the first handle locking element and the second base locking element inter-engages the second handle locking element to prevent the first storage bin from being lifted from the second storage bin.

18. The pair of storage bins of claim 17, wherein the main body of the first storage bin comprises first and second slots, each of the first and second slots comprising a plurality of interlocking teeth configured to limit movement of the first storage bin relative to the second storage bin in the locked position.

19. The pair of storage bins of claim 17, wherein each of the first movable handle and the second movable handle is rotatably connected to the main body of the second storage bin about an axis of rotation between the opened position and the closed position.

20. The pair of storage bins of claim 19, wherein the main body of the second storage bin further comprises a first set of oblong holes and a second set of oblong holes, the first movable handle comprises first and second ends projecting into the oblong holes of the first set to enable the first movable handle to be rotatably connected to the main body, the second movable handle comprises first and second ends projecting into the oblong holes of the second set to enable the second movable handle to be rotatably connected to the main body.

* * * * *